US009682561B2

(12) United States Patent
Matsuzaki et al.

(10) Patent No.: US 9,682,561 B2
(45) Date of Patent: Jun. 20, 2017

(54) RECORDING APPARATUS

(71) Applicant: SEIKO EPSON CORPORATION, Tokyo (JP)

(72) Inventors: Kazutoshi Matsuzaki, Shiojiri (JP); Kazuhiro Nishiyama, Shiojiri (JP); Tetsuji Yatsunami, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/874,109

(22) Filed: Oct. 2, 2015

(65) Prior Publication Data

US 2016/0096385 A1 Apr. 7, 2016

(30) Foreign Application Priority Data

Oct. 3, 2014 (JP) ..... 2014-204897

(51) Int. Cl.
*B41J 25/308* (2006.01)
*B41J 2/165* (2006.01)

(52) U.S. Cl.
CPC ..... *B41J 2/16511* (2013.01); *B41J 2/16508* (2013.01); *B41J 25/3082* (2013.01)

(58) Field of Classification Search
CPC ..... B41J 2/16511; B41J 2/16508; B41J 25/3082; B41J 25/3086; B41J 25/3088
See application file for complete search history.

(56) References Cited

U.S. PATENT DOCUMENTS

2009/0309921 A1 12/2009 Ohyama et al.
2010/0020124 A1* 1/2010 Okazaki ..... B41J 2/16532 347/29
2010/0118082 A1 5/2010 Tojo
2013/0070023 A1* 3/2013 Ohashi ..... B41J 25/308 347/37

FOREIGN PATENT DOCUMENTS

JP 2010-023501 2/2010
JP 2010-201911 9/2010
JP 2013-063617 4/2013

* cited by examiner

*Primary Examiner* — Jason Uhlenhake
(74) *Attorney, Agent, or Firm* — Workman Nydegger

(57) ABSTRACT

A recording apparatus includes: a carriage that has a housing in which a recording head is provided; a guide member that guides the carriage; a gap adjusting unit that adjust a gap between the medium and the recording head; and a cap member by which the recording head is capped. The gap adjusting unit includes a sliding member that slides over the guide member, a cam member that is interposed between a part of the housing and the sliding member and has a shape with which the housing is caused to shift in the direction in which the gap is changed, by moving in the first direction relative to the housing and the sliding member, and a pressing member that presses the cam member to the housing of the carriage in a second direction intersecting with the first direction and the direction in which the gap is changed.

8 Claims, 16 Drawing Sheets

RECORDING APPARATUS

BACKGROUND

1. Technical Field

The present invention relates to a recording apparatus that performs recording on a medium.

2. Related Art

In the related art, in a recording apparatus, a distance (gap) between a recording head which discharges ink on a medium and the medium is changed so as to correspond to a thickness of a medium, which is different in accordance with a type of medium, and to maintain recording quality on the medium. In addition, when the recording head is not used, the recording head is capped by a cap member which is contactable with and separable from the recording head so as to prevent a nozzle, through which ink is discharged, from drying or to maintain the recording head in an appropriate state.

There is provided a recording apparatus that includes a gap adjusting unit for changing the gap and maintain the changed gap (see JP-A-2013-63617). In the recording apparatus disclosed in JP-A-2013-63617, the gap adjusting unit is provided in a carriage including a recording head and includes a sliding member which slides on a guide member and a cam member which is supported by the sliding member and adjusts a gap.

The cam member has a step-like cam surface which abuts on the sliding member. In the recording apparatus, the cam member has a structure to be interposed between a housing of the carriage and the sliding member in a direction in which the gap is changed. The cam member moves relative to the sliding member, which causes an abutting position of the cam surface with the sliding member to be changed. As a result, the recording apparatus has a configuration in which a position of the housing of the carriage is changed with respect to the sliding member in the direction in which the gap is changed and a gap between the medium and the recording head is adjusted.

In addition, the recording apparatus includes a bias member which biases the sliding member to the carriage with the cam member interposed therebetween, in the direction in which the gap is changed. However, in the configuration, a bias force of the bias member acts in the direction in which the gap is changed. As a result, when the gap is switched to another gap, the bias force by the bias member acts as a load on the gap adjusting unit. In this manner, loads increase during a gap switching operation of the gap adjusting unit.

Incidentally, there is also provided a recording apparatus that includes the cap member by which the recording head is capped when the recording head is not used (see JP-A-2010-201911). As illustrated in FIG. 17, the recording apparatus includes a cap member 88 which is provided at a position below a recording head 86 at a home position in a moving region of a carriage 84 and which is movable in the direction in which the gap is changed. An engagement section 90 is provided integral with the cap member 88. In addition, when the engagement section 90 is pressed by the carriage 84 in an apparatus width direction, the cap member 88 moves along a slit 92 provided in a moving direction of the carriage 84.

Specifically, when a housing 94' of the carriage 84 comes into contact with an engagement section 90' and the engagement section 90' is pressed and is caused to move toward the home position side (−X axial direction side in FIG. 17), a cap member 88' moves toward the home position side and starts moving toward the recording head 86' in an apparatus height direction. Then, the cap member 88 comes into contact with the recording head 86. Further, the carriage 84 decelerates while moving to the home position in a state in which the cap member 88 is in contact with the recording head 86, and the carriage 84 stops at the home position. In this manner, it is possible for the recording head 86 to be reliably capped by the cap member 88.

When the carriage 84 disclosed in JP-A-2010-201911 has the gap adjusting unit disclosed in JP-A-2013-63617, that is, the configuration, in which the cam member is biased to the housing in the direction in which the gap is changed, a force resistant to a press force of the cap member 88 during the capping is needed to prevent the carriage 84 from separating from the guide member during the capping and the bias force of the bias member increases and acts as a load on the gap adjusting unit. As a result, the loads increase during the gap switching operation.

In addition, in a case where the carriage 84 disclosed in JP-A-2010-201911 does not have the configuration, in which the cam member is biased to the housing in the direction in which the gap is changed, there is a concern that the carriage 84 will be lifted from the guide member by the press force of the cap member 88 during the capping so as to separate from the guide member. Here, for example, when a regulation section is provided on the guide member and regulates a shift of the sliding member in the direction in which the gap is changed, the shift of the sliding member is regulated in the direction in which the gap is changed. As a result, the carriage 84 is separated from the sliding member during capping.

In this state, in a case where the carriage 84 decelerates approaching the home position, an inertial force obtained by multiplying the weight of the cam member by an acceleration of a carriage during deceleration is applied to the cam member. As a result, there is a concern that the cam member is likely to unexpectedly move with respect to the carriage 84 such that a gap between the medium and the recording head will be changed. There is a concern that the cam member will unexpectedly move with respect to the carriage 84 even during acceleration when the carriage 84 moves to a recording region side of the medium from the home position.

In addition, when the carriage 84 is lifted and separated from the guide member even in a state in which the carriage is not caused to move, there is a concern that the cam member will unexpectedly move with respect to the carriage due to vibration or the like.

SUMMARY

An advantage of some aspects of the invention is to provide a recording apparatus in which it is possible to regulate a movement of a cam member with respect to a housing and a sliding member of a carriage with light loads even in a state in which the carriage is lifted through capping.

A recording apparatus of a first aspect of the invention includes: a carriage that has a housing in which a recording head is provided and performs recording on a medium and that is movable in a first direction; a guide member that extends in the first direction, supports the carriage, and guides the carriage in the first direction; a gap adjusting unit that adjusts a position of the housing with respect to the guide member and thereby adjusts a gap between the medium and the recording head; and a cap member which is movable in a direction in which the gap is changed, and by which the recording head is capped. The gap adjusting unit includes a sliding member that slides over an upper side of the guide member in response to a movement of the carriage, a cam member that is interposed between a part of the housing and the sliding member and has a shape with which the housing of the carriage is caused to shift in the direction in which the gap is changed, by moving in the first direction relative to the housing and the sliding member, and a pressing member that presses the cam member to the housing of the carriage in a second direction intersecting with the first direction and the direction in which the gap is changed.

According to the aspect, the pressing member is provided to press the cam member, which changes the gap between the housing and the medium by moving in the first direction relative to the housing and the sliding member, to the housing of the carriage in the second direction intersecting with the first direction and the direction in which the gap is changed. In this manner, for example, when the recording head is capped by the cap member, the housing is lifted such that the cam member and the sliding member are separated from each other in the direction in which the gap is changed. Even in this case, since the cam member is pressed to the housing by the pressing member, it is possible to suppress the cam member not to move relative to the housing of the carriage and the sliding member. In addition, since a force for suppressing the relative movement of the cam member with respect to the housing only needs to be equal to or greater than an inertial force obtained by multiplying the weight of the cam member and an acceleration of the carriage during acceleration or deceleration, it is possible to reduce the press force of the pressing member. As a result, it is possible to regulate the relative movement of the cam member with respect to the housing of the carriage and the sliding member, with a low load.

In addition, according to the aspect, the press force of pressing the cam member to the housing of the carriage does not act in the direction in which the gap is changed. Therefore, the press force is not applied as an extra load during gap switching by the gap adjusting unit such that it is possible to reduce loads during the gap switching.

In the recording apparatus of a second aspect of the invention according to the first aspect, the cam member may engage with the housing of the carriage.

According to the aspect, the cam member shifts integral with the housing of the carriage in the direction in which the gap is changed. Thus, when the housing shifts with respect to the sliding member in the direction in which the gap is changed, it is possible to prevent the cam member from being subjected to torsion due to a difference between a frictional force on a side of the cam member on which the cam member comes into contact with the housing and a frictional force on another side on which the cam member comes into contact with the sliding member.

In the recording apparatus of a third aspect of the invention according to the first or second aspect, the pressing member may press the cam member to the housing of the carriage through the sliding member.

According to the aspect, the pressing member presses the cam member through the sliding member. Here, when the pressing member is a spring as an example and the cam member moves along with the carriage relative to the sliding member in a configuration of directly pressing the cam member, the spring is also bent in response to the movement of the cam member and thus, the direction of the force of pressing the cam member is changed. As a result, it is not possible to stably press the cam member to the carriage. According to the aspect, since the pressing member presses the cam member through the sliding member, the direction of the press force of the pressing member is not changed even when the cam member moves. As a result, the pressing member can stably press the cam member to the carriage.

In the recording apparatus of a fourth aspect of the invention according to the first or second aspect, the cam member may be pressed by the sliding member at at least two positions with intervals in the first direction.

According to the aspect, the cam member is pressed by the sliding member at at least two positions with intervals in the first direction. Here, if the cam member is pressed at one position in the first direction, there is a concern that torsion will be generated between the cam member and the sliding member due to angular moment generated in the carriage during acceleration or deceleration of the carriage. In the aspect, since the cam member is pressed at at least the two positions with intervals in the first direction, it is possible to suppress the concern that torsion will be generated between the cam member and the sliding member. As a result, it is possible to prevent an unstable movement of the carriage in the first direction due to the generated torsion and thus to prevent recording quality from deteriorating.

In the recording apparatus of a fifth aspect of the invention according to the fourth aspect, the pressing member may press the sliding member between at least the two pressing positions in the first direction.

According to the aspect, since the pressing member presses the sliding member between at least the two pressing positions in the first direction, it is possible for the press force of the pressing members to be uniformly applied to the cam member through the sliding member at at least the two pressing positions in the first direction, and it is possible to consistently press the cam member to the housing of the carriage.

In the recording apparatus of a sixth aspect of the invention according to the first or second aspect, the cam member may be pressed by the pressing members at at least two positions with intervals in the first direction.

According to the aspect, the cam member is pressed by the pressing members at at least two positions with intervals in the first direction. Here, if the cam member is pressed at one position in the first direction, there is a concern that torsion will be generated between the cam member and the pressing member due to angular moment generated in the carriage during acceleration or deceleration of the carriage. In the aspect, since the cam member is pressed at at least two positions with intervals in the first direction, it is possible to suppress the concern that torsion will be generated between the cam member and the pressing member. As a result, it is possible to prevent an unstable movement of the carriage in the first direction due to the generated torsion and thus to prevent recording quality from deteriorating.

In the recording apparatus of a seventh aspect of the invention according to the first to sixth aspects, the pressing member may move along with the shift of the carriage in the direction in which the gap is changed.

According to the aspect, since the pressing member is able to move along with the shift of the carriage in the direction in which the gap is changed, the pressing member is able to stably press the carriage without changing the pressing direction of the pressing member to the carriage.

A recording apparatus of an eighth aspect of the invention includes a carriage that has a housing in which a recording head is provided and performs recording on a medium and that is movable in a first direction; a guide member that extends in the first direction, supports the carriage, and guides the carriage in the first direction; a gap adjusting unit that adjusts a position of the housing with respect to the guide member and thereby adjusts a gap between the medium and the recording head; and a cap member which is movable in a direction in which the gap is changed, and by which the recording head is capped. The gap adjusting unit includes a sliding member that slides over an upper side of the guide member in response to a movement of the carriage, a cam member that is interposed between a part of the housing and the sliding member and has a shape with which the housing of the carriage is caused to shift in the direction in which the gap is changed, by moving in the first direction relative to the housing and the sliding member, and an elastic member that is provided between the housing of the carriage and the cam member in a second direction intersecting with the first direction and the direction in which the gap is changed and that biases the cam member with respect to the sliding member.

According to the aspect, the elastic member is provided between the carriage and the cam member and biases the cam member with respect to the sliding member. The cam member receives a reactive force from the sliding member and is biased to the carriage through the elastic member. In this manner, for example, when the recording head is capped by the cap member, the housing is lifted and the cam member such that the sliding member are separated from each other in the direction in which the gap is changed. Even in this case, since the cam member is pressed against the housing, it is possible to suppress the cam member not to move relative to the housing of the carriage and the sliding member. In addition, since a force for suppressing the relative movement of the cam member with respect to the housing only needs to be equal to or greater than an inertial force obtained by multiplying the weight of the cam member and an acceleration of the carriage during acceleration or deceleration, it is possible to reduce the bias force of the elastic member. As a result, it is possible to regulate the relative movement of the cam member with respect to the housing of the carriage and the sliding member, with a low load. In addition, since the force of suppressing the relative movement of the cam member with respect to the housing only needs to be equal to or greater than the inertial force obtained by multiplying the weight of the cam member and an acceleration of the carriage during acceleration or deceleration, it is possible to reduce the bias force of the elastic member. As a result, it is possible to regulate the relative movement of the cam member with respect to the housing of the carriage and the sliding member, with a low load.

In addition, according to the aspect, the bias force from the elastic member and the reactive force from the sliding member does not act in the direction in which the gap is changed. Therefore, the press force is not applied as an extra load during gap switching by the gap adjusting unit such that it is possible to reduce loads during the gap switching.

In the recording apparatus of a ninth aspect of the invention according to the eighth aspect, the elastic member may be a cylindrical member having an axis of the elastic member, which extends in the direction in which the gap is changed.

According to the aspect, since the elastic member is the cylindrical member having the axis of the elastic member, which extends in the direction in which the gap is changed, the cylindrical member rotates between the carriage and the cam member such that it is possible to reduce a sliding resistance of the cam member, when the cam member moves in the first direction and the gaps are switched. In other words, it is possible to reduce the loads during the gap switching of the gap adjusting unit.

In the recording apparatus of a tenth aspect of the invention according to the eighth or ninth aspect, the cam member may be biased by the elastic members at at least two positions with intervals in the first direction.

According to the aspect, the cam member is biased by the elastic members at at least two positions with intervals in the first direction. Here, if the cam member is biased by the elastic member at one position in the first direction, there is a concern that torsion will be generated between the cam member and the sliding member, or between the cam member and the elastic member, due to angular moment generated in the carriage during acceleration or deceleration of the carriage. In the aspect, since the cam member is biased by the elastic member at at least the two positions with intervals in the first direction, it is possible to suppress the concern that torsion will be generated between the cam member and the sliding member, or between the cam member and the elastic member. As a result, it is possible to prevent an unstable movement of the carriage in the first direction due to the generated torsion and thus to prevent recording quality from deteriorating.

In the recording apparatus of an eleventh aspect of the invention according to the first to tenth aspects, the sliding member may have a regulation section which comes into contact with the cam member and regulates a shift of the cam member in the direction in which the gap is changed, and the gap adjusting unit may perform switching between a regulation state in which the regulation section regulates a shift of the cam member in the direction in which the gap is changed and a non-regulation state in which the cam member is caused to move relative to the sliding member and thereby the regulation state is cancelled.

According to the aspect, since the sliding member has a regulation section which comes into contact with the cam member and regulates the shift of the cam member in the direction in which the gap is changed, it is possible to reliably maintain the gap of the carriage in a case where the sliding member and the cam member are in the regulation state. For example, when a gap position in the regulation state is set to a gap position of regular paper on which recording is performed the most number of times, it is possible to easily maintain recording quality of the regular paper.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
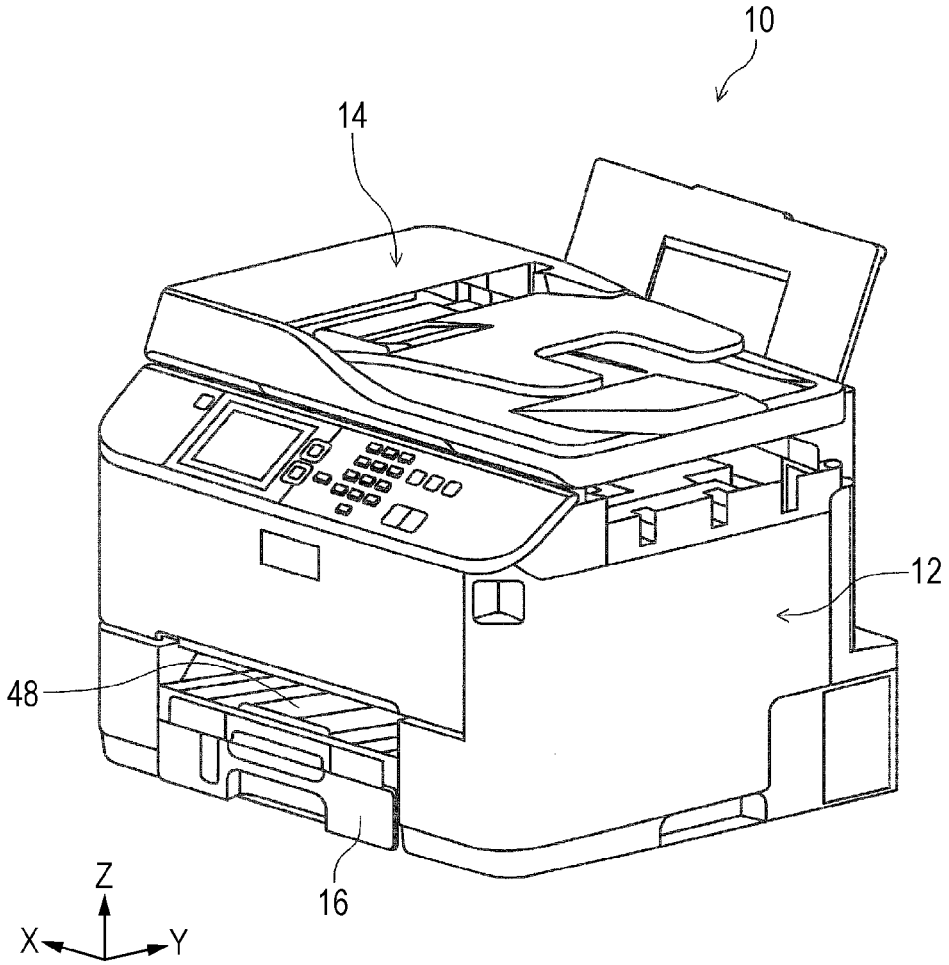
FIG. 1 is a perspective view of an external appearance of a printer according to the invention.

Hereinafter, embodiments of the invention will be described with reference to the drawings. The same reference sign is attached to the same configuration according to examples, a description is provided for the first example, and a description of the configuration according to the following examples is omitted.

In addition, in an X-Y-Z coordinate system in the drawings, an X direction as a "first direction" indicates a main scanning direction of a recording head, a Y direction as a "second direction" indicates a depth direction and a sheet transport direction of a recording apparatus, and a Z direction indicates a "direction in which a distance (gap) between the recording head and the sheet is changed, that is, an apparatus height direction. In the drawings, −Y direction means a front side of the apparatus and +Y direction means a rear side of the apparatus.

First Example

Outline of Printer

An ink jet printer 10 (hereinafter, referred to as a printer 10) will be described as an example of the recording apparatus with reference to FIG. 1. The printer 10 is configured as a multifunction printer that includes an apparatus main body 12 and an image reading apparatus 14. The apparatus main body 12 includes a paper-sheet accommodating cassette 16 in which a paper sheet P (refer to FIG. 2) as a "medium" is accommodated. The paper-sheet accommodating cassette 16 is attached to be detachable from a front side (−Y direction side in FIG. 1) of the apparatus main body 12. An example of the paper sheet P in this specification includes a paper sheet such as regular paper, cardboard, or photographic paper.

Subsequently, a paper-sheet transport path in the printer 10 will be described with reference to FIG. 2. A pick-up roller 18 is provided above the paper-sheet accommodating cassette 16 in the apparatus main body 12, that is, at a position facing the paper sheet P accommodated in the paper-sheet accommodating cassette 16. The pick-up roller 18 is configured to be swingable in a direction of approaching or separating from the paper sheet P accommodated in the paper-sheet accommodating cassette 16. The pick-up roller 18 is caused to rotate and be driven by a drive source (not illustrated).

The paper sheet P set in the paper-sheet accommodating cassette 16 is sent out by the pick-up roller 18 to a feeding unit 20 positioned on the downstream side on the transport path. The feeding unit 20 includes a feeding roller 22, a first driven feeding roller 24, and a second driven feeding roller 26. The feeding roller 22 is caused to rotate by a drive source (not illustrated).

The paper sheet P sent out from the paper-sheet accommodating cassette 16 is nipped between the feeding roller 22 and the first driven feeding roller 24. The paper sheet P is fed to the downstream side in the transport direction along the outer circumferential surface of the feeding roller 22. Then, the paper sheet P is nipped between the feeding roller 22 and the second driven feeding roller 26 and is fed to the transport unit 28 positioned on the downstream side in the transport direction of the feeding unit 20.

The transport unit 28 includes a driving transport roller 30 and a driven transport roller 32. The driving transport roller 30 is caused to rotate by a drive source (not illustrated). The paper sheet P transported to the transport unit 28 is nipped between the driving transport roller 30 and the driven transport roller 32 and is transported to the downstream side in the transport direction.

A recording unit 34 is provided on the downstream side in the transport direction of the transport unit 28. The recording unit 34 includes a carriage 36, a recording head 38, and a platen 40 which faces the recording head and supports the paper sheet P. The recording head 38 is provided on the bottom of the carriage 36 and faces the paper sheet P.

In addition, the carriage 36 is driven by a drive source (not illustrated) controlled by a control unit (not illustrated) which is provided in the apparatus main body 12 such that the carriage 36 reciprocates in the main scanning direction (paper front-back direction in FIG. 2, that is an X axial direction), that is in the apparatus width direction. In addition, the platen 40 supports the paper sheet P from below and thereby defines a distance (gap PG) between a recording surface of the paper sheet P and the head surface of the recording head 38. The gap PG will be described below. The paper sheet P transported to the recording unit 34 is supported by the platen 40 and recording is performed thereon at a position at which to face the recording head 38.

A discharge unit 42 is provided on the downstream side in the transport direction of the recording unit 34. The discharge unit 42 includes a driving discharge roller 44, a driven discharge roller 46, and a discharge stacker 48. The paper sheet P, on which the recording is performed in the recording unit 34, is nipped between the driving discharge roller 44 and the driven discharge roller 46 and is discharged toward the discharge stacker 48 positioned on the front side of the apparatus. The driving discharge roller 44 is caused to rotate by a drive source (not illustrated).

In addition, in a case where recording is performed on both surfaces of the paper sheet P in the printer 10, the recording unit 34 performs recording on a first surface of the paper sheet P and then, a side of a sheet following end of the paper sheet P when the recording is performed on the first surface becomes a leading end thereof and the paper sheet P is sent to a reverse path 50 through a reverse feeding operation of the driving transport roller 30 and the driving discharge roller 44. The reverse path 50 is provided to extend from the transport unit 28 in the apparatus rear direction (+Y axial direction side in FIG. 2) and to join the transport path of the paper sheet P from the paper-sheet accommodating cassette 16 below the feeding roller 22 (−Z direction in FIG. 2).

Hence, the paper sheet P is again sent to the recording unit 34 through the transport path and the feeding roller 22 from the reverse path 50 and recording is performed on a second surface. After performing the recording, the paper sheet P is nipped between the driving discharge roller 44 and the driven discharge roller 46 and is discharged to the discharge stacker 48 provided on the front side of the apparatus.

Outline of Carriage

Figure 3:
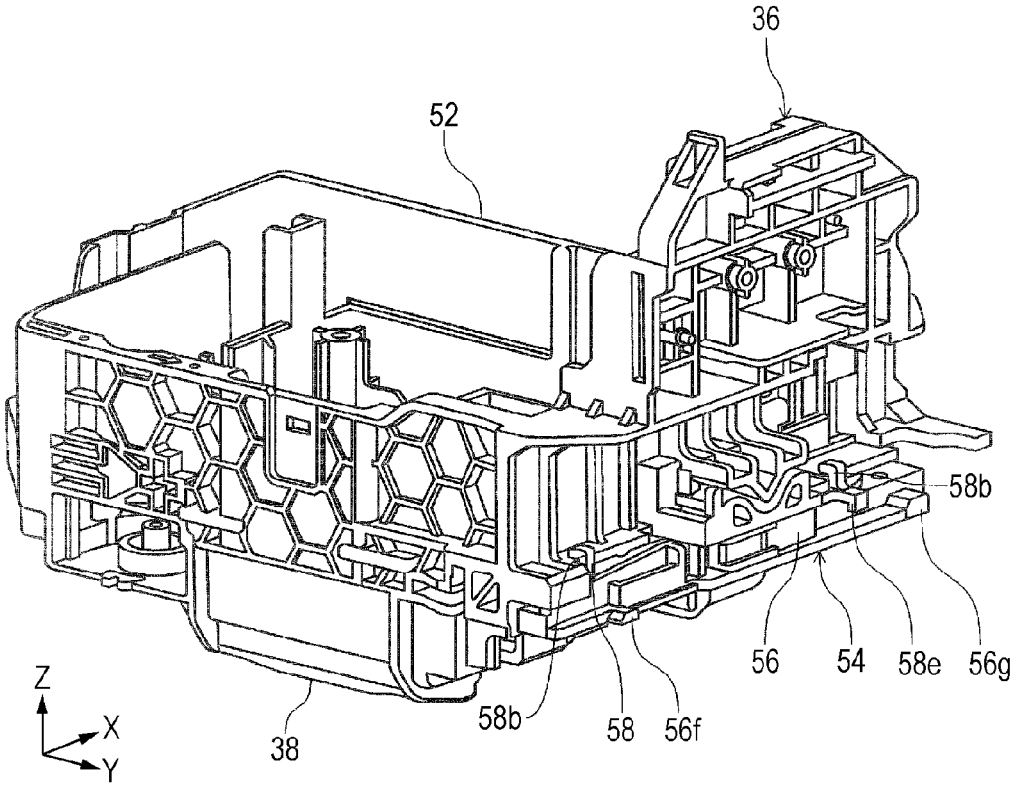
FIG. 3 is a perspective view illustrating a rear side of a carriage according to a first example.
Figure 4:
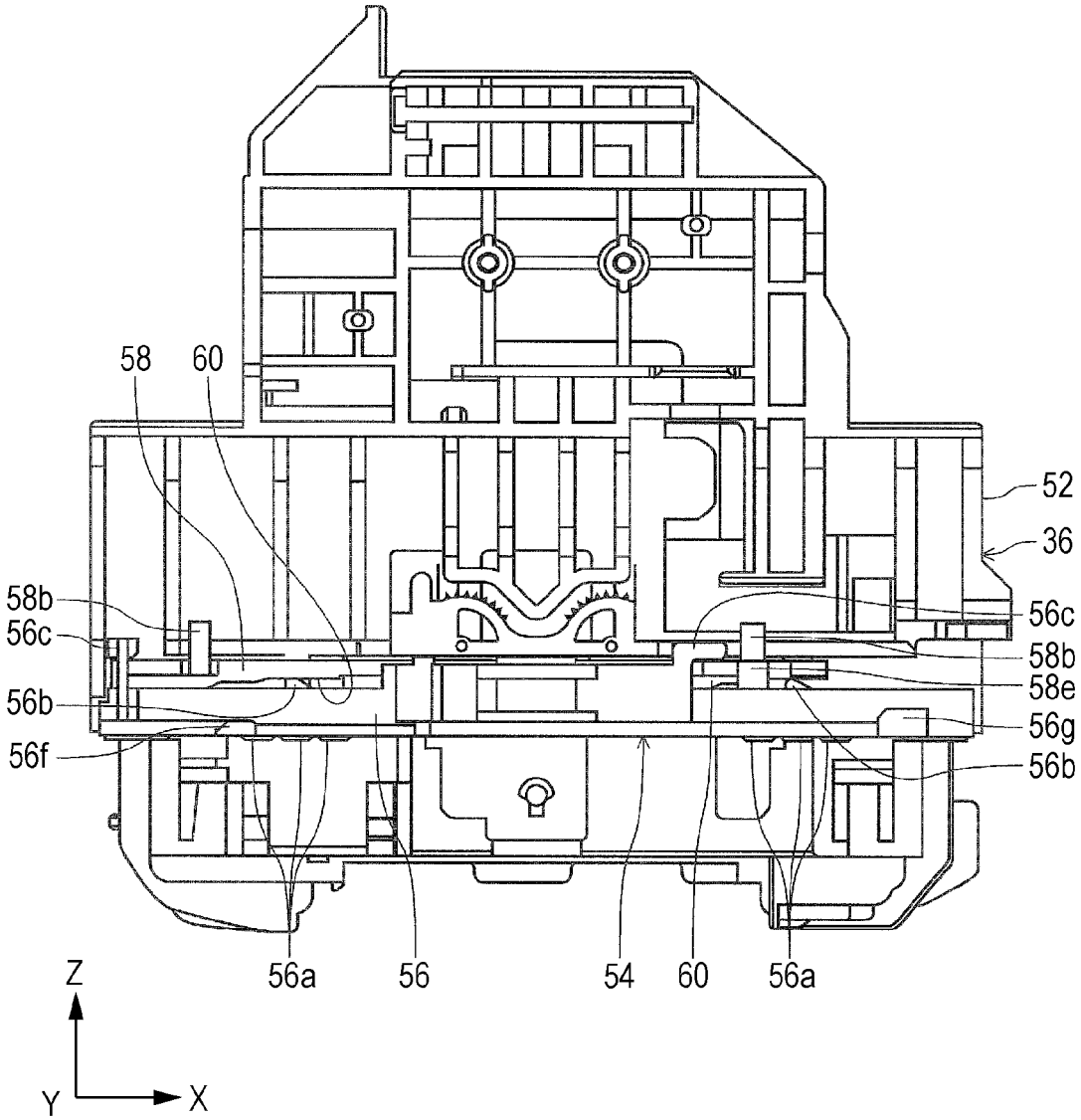
FIG. 4 is a rear view of the carriage according to the first example.

Subsequently, a configuration of the carriage 36 will be described with reference to FIG. 2 to FIG. 4. The carriage 36 includes a housing 52 which is opened on the upper side (+Z axial direction side in FIG. 3) in the apparatus height direction, and gap adjusting units 54. The gap adjusting units 54 are provided at an end portion of the housing 52 on the front side of the apparatus (−Y axial direction side in FIG. 3) and at another end portion of the housing 52 on the rear side of the apparatus (+Y axial direction side in FIG. 3), respectively. The gap adjusting unit 54 provided at the end portion of the housing 52 on the front side of the apparatus is not illustrated in the drawings.

In addition, the gap adjusting units 54 provided at the end portion of the housing 52 on the front side of the apparatus and at the other end portion of the housing 52 on the rear side of the apparatus, respectively, are configured such that a shift of the gap adjusting unit 54 on the housing 52 on the rear side of the apparatus is transmitted to the gap adjusting unit 54 (not illustrated) on the housing 52 on the front side of the apparatus through a linkage mechanism (not illustrated).

Figure 2:
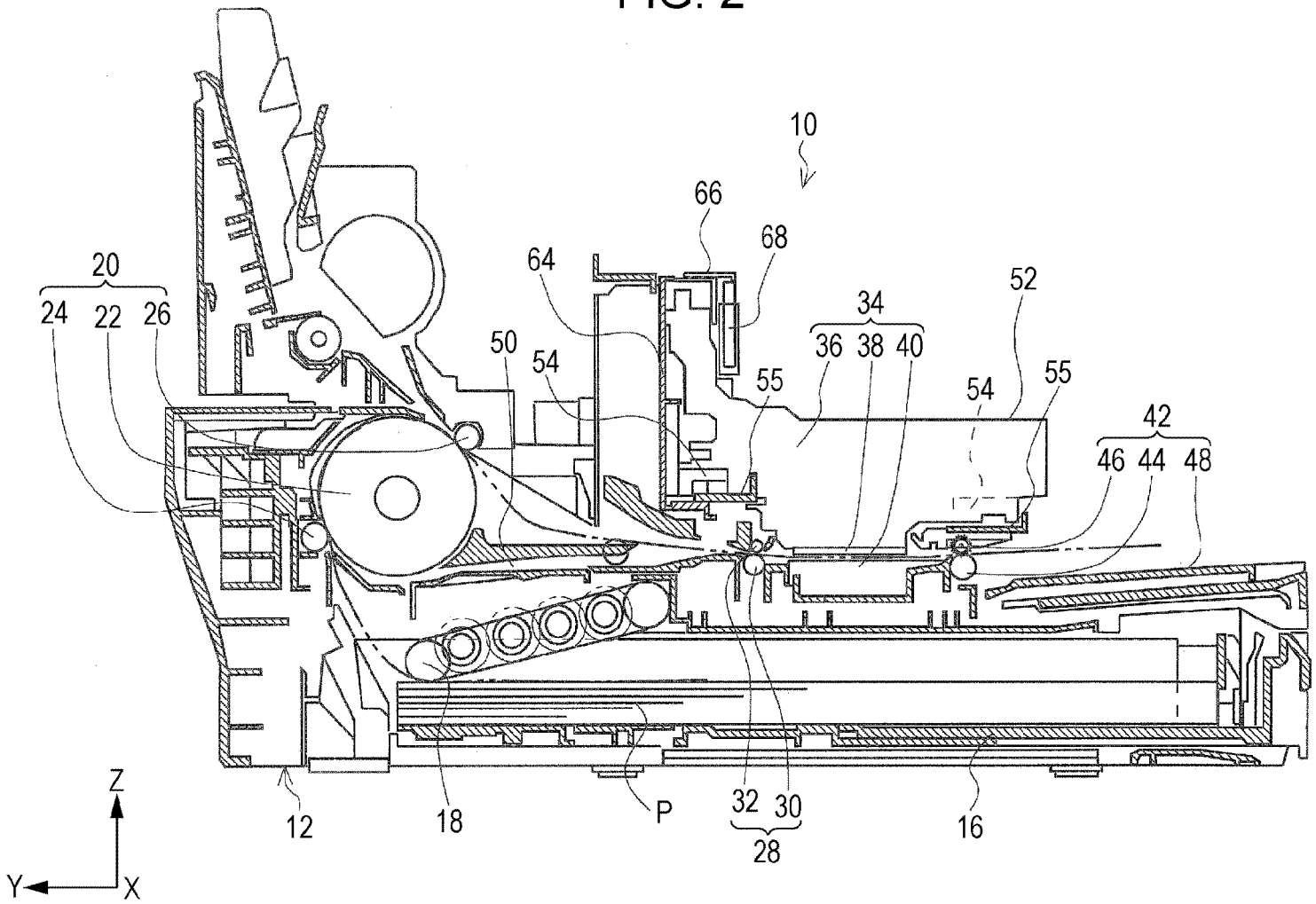
FIG. 2 is a sectional side view illustrating a medium transporting path of the printer according to the invention.

In addition, the carriage 36 is configured to be movable in the apparatus width direction (paper front-back direction in FIG. 2) in FIG. 2 by a carriage driving mechanism (not illustrated). As an example, the carriage driving mechanism (not illustrated) is configured as an endless belt driving mechanism that causes the carriage 36 to move in the apparatus width direction by causing a timing belt which loops between two pulleys provided in the apparatus main body 12 with an interval in the apparatus width direction and, a part of which is gripped in the carriage 36, to be driven.

Figure 9:
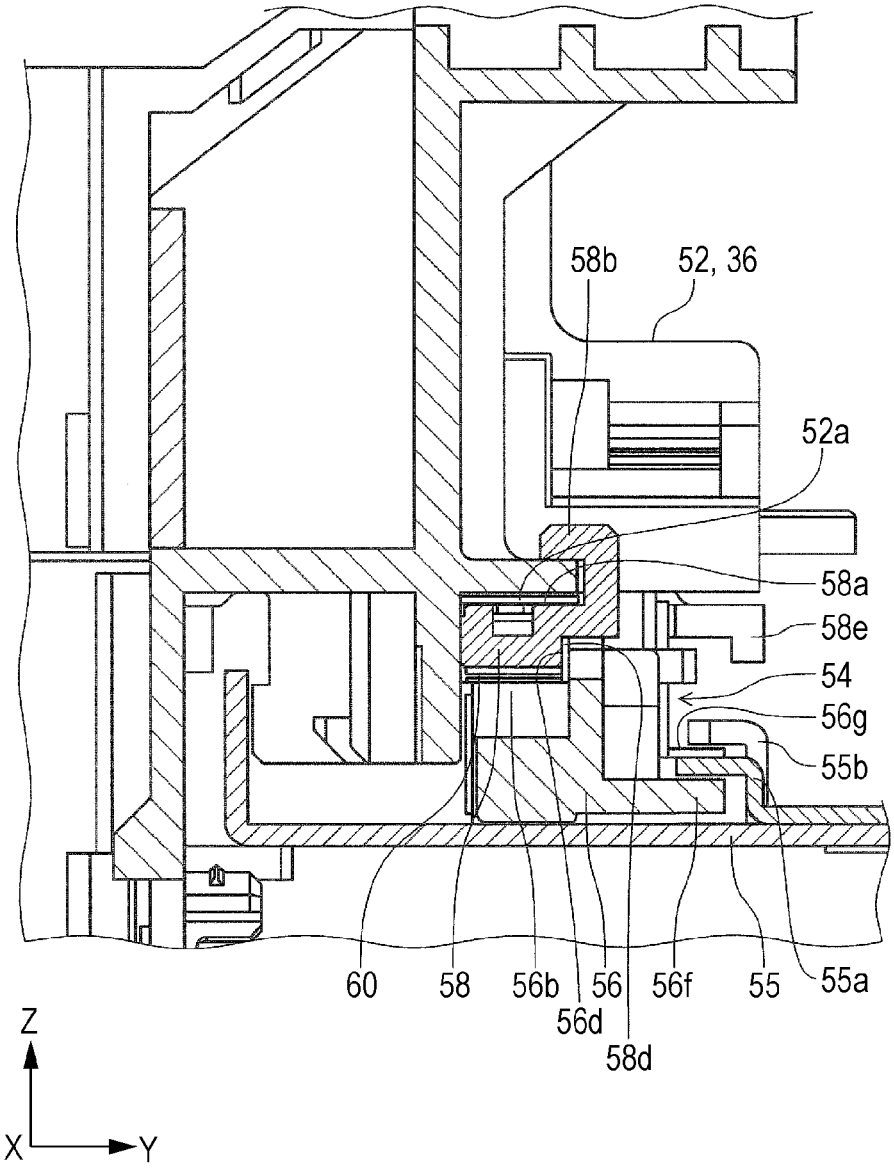
FIG. 9 is a sectional view illustrating the gap adjusting unit over a guide member when viewed in an apparatus width direction.

In addition, as illustrated in FIG. 2 and FIG. 9, the carriage 36 is configured to be supported on guide members 55 and to move on the guide members 55. Specifically, the guide members 55 and 55 are configured to be disposed in the apparatus depth direction (Y axial direction in FIG. 2) with an interval and, as a pair of members, to support the gap adjusting units 54 and 54, respectively. The guide members 55 and 55 are configured to extend in the apparatus width direction (X axial direction in FIG. 9) corresponding to the main scanning direction, and to guide the carriage 36 when the carriage 36 moves in the apparatus width direction. The guide members 55 and 55 according to the present example are configured of a metal material.

Regarding Cap Member

Figure 15:
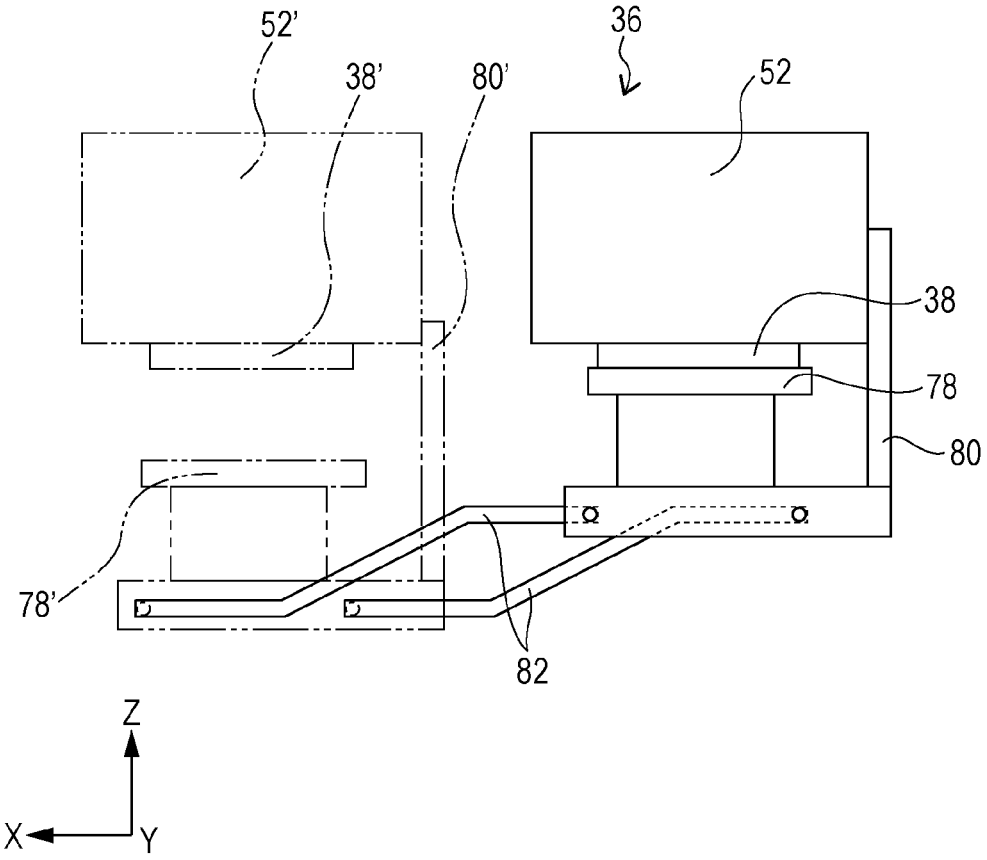
FIG. 15 is a view illustrating capping by a cap member according to the invention.

The cap member 78 according to the present example will be described with reference to FIG. 15. In the present example, a home position is provided at one end portion (end portion on the −X axial direction side in FIG. 1) in a movement region of the carriage 36 in the apparatus width direction. In addition, the home position is set at a position shifted from a recording performed region on the paper sheet P in the movement region of the carriage.

The cap member 78 which is positioned below the carriage 36 and is movable in the apparatus height direction is provided in the apparatus main body 12 at a position corresponding to the home position of the carriage 36. An engagement section 80 which can engage with a part of the housing 52 of the carriage 36 is provided in the cap member 78. In addition, the cap member 78 is configured to be movable in the apparatus width direction along slits 82 and 82 provided in the apparatus main body 12.

When the carriage 36 moves to the home position side in the movement region, the housing 52 engages with an engagement section 80'. At this time, the cap member 78' is positioned under the recording head 38'. When the carriage 36 which engages with the engagement section 80' further moves to the home position side, the cap member 78' moves to the home position along the slit 82 and moves upward in the apparatus height direction. Then, the cap member 78' comes into contact with the recording head 38'. In other words, the cap member 78 enters into a state in which the recording head 38 is capped. In this manner, a nozzle of the recording head 38 is prevented from being dried, or the recording head 38 is maintained in an appropriate state while the printer 10 is not used.

The carriage 36 decelerates and moves to the home position in the apparatus width direction in a state in which the recording head 38 is capped by the cap member 78. The cap member 78 moves to the home position in the state in which the recording head 38 is capped and thereby, it is possible for the recording head 38 to be reliably capped by the cap member 78. When the recording head 38 is capped by the cap member 78, the cap member 78 presses the housing 52 of the carriage 36 through the recording head 38 such that the housing 52 is lifted upward in the apparatus height direction.

In the present example, a gap regulating unit in a gap PG1 regulates the housing 52 not to be lifted from the guide member 55 in the gap PG1 and a description thereof will be provided below. In addition, an engagement member 68 to be described below regulates an upward shift of the housing 52 in gaps PG3 and PG4. In the gap PG2, when the housing 52 shifts upward in the apparatus height direction, a cam member 58 shifts upward along with the housing 52 in the apparatus height direction and separates from a sliding member 56.

Regarding Gap Adjusting Unit

Subsequently, the gap adjusting unit 54 will be described with reference to FIG. 3 to FIG. 12. The gap adjusting unit 54 includes the sliding member 56, the cam member 58, and a pressing member 62. The sliding member 56 and the cam member 58 are configured to move in the apparatus width direction along with the carriage 36. In addition, the cam member 58 is provided in the housing 52 to be movable in the apparatus width direction, relative to the housing 52 and the sliding member 56. The cam member 58 moves in the apparatus width direction, relative to the housing 52 and to the sliding member 56 and thereby, the gap PG between the recording head 38 and the recording surface of the paper sheet P, that is, the platen 40, is changed.

A sliding section 56*a* is formed on the under-surface side (−Z axial direction side in FIG. 4) of the sliding member 56 and comes into contact with and slides on the guide member 55. When the carriage 36 is guided to the guide member 55 and moves in the apparatus width direction, the sliding section 56*a* slides on the top surface of the guide member 55. In addition, supports 56*b* are formed at at least two positions on the top surface side of the sliding member 56 (+Z axial direction side in FIG. 6A and FIG. 6B) with intervals in the apparatus width direction. The supports 56*b* support the cam member 58.

Figure 6A:
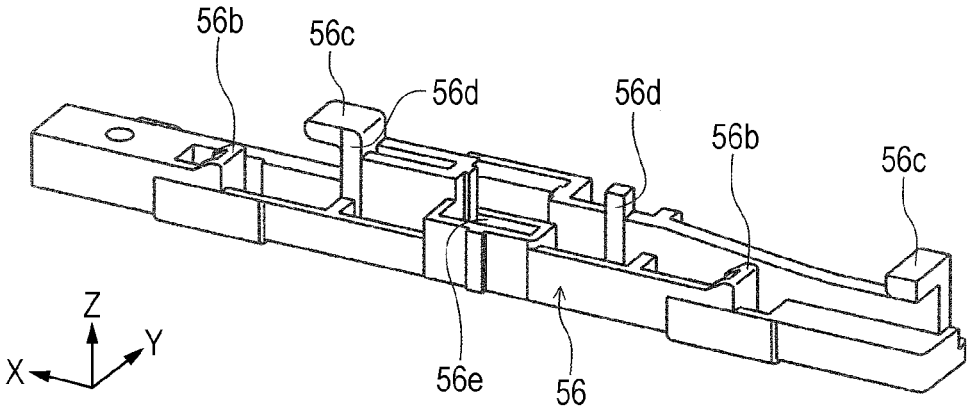
FIG. 6A is a perspective view of a sliding member when viewed from a front side of the apparatus and FIG. 6B is a perspective view of the sliding member when viewed from a rear side of the apparatus.
Figure 6B:
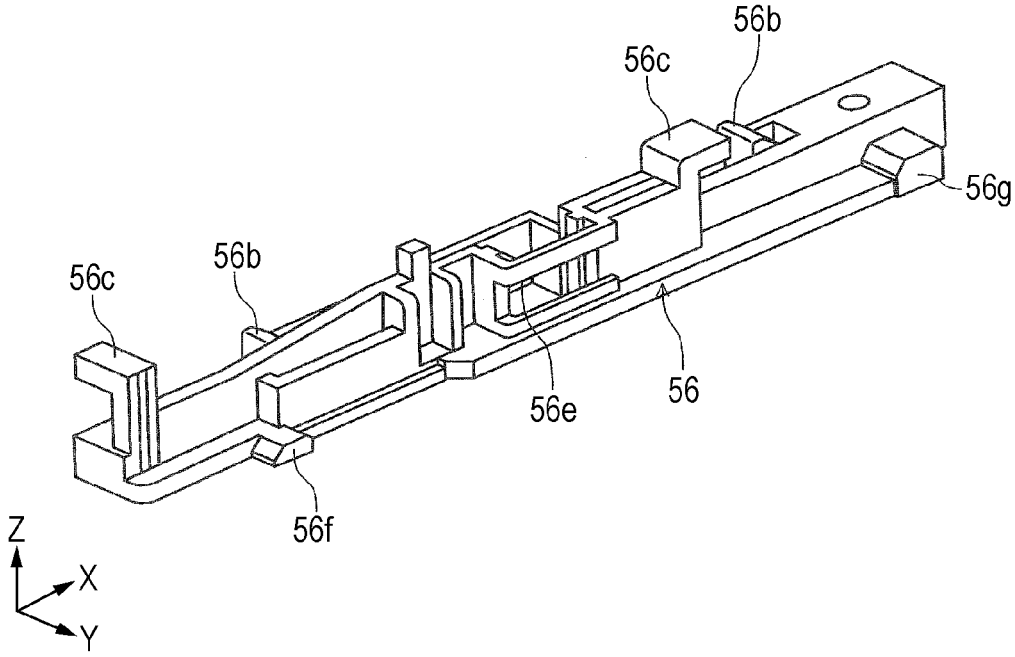

In addition, a regulation section 56*c* is provided on the sliding member 56 on the top surface side (+Z axial direction side in FIG. 6A and FIG. 6B). The regulation section 56*c* will be described below. In addition, contact sections 56*d* and 56*d* are formed on the sliding member 56 facing the front side of the apparatus (−Y axial direction side in FIG. 6A and FIG. 6B) with an interval in the apparatus width direction. In addition, a pressing-member-accommodating section 56*e* is provided at the center portion in the apparatus width direction in the sliding member 56. In addition, a first regulated section 56*f* and a second regulated section 56*g* are provided on the lower portion of the sliding member 56. The first regulated section 56*f* and the second regulated section 56*g* will be described below.

Subsequently, with reference to FIG. 7A and FIG. 7B, the cam member 58 has a step-like cam surfaces 60 on the under surface. The step-like cam surfaces 60 are configured to have a first abutting section 60*a*, a second abutting section 60*b*, a third abutting section 60*c*, and a fourth abutting section 60*d*. The abutting sections 60*a*, 60*b*, 60*c*, and 60*d* are configured to be supported by the support 56*b* formed on the top surface side of the sliding member 56. In addition, the abutting sections 60*a*, 60*b*, 60*c*, and 60*d* are configured to be connected by smoothly inclined surfaces such that the cam member 58 is smoothly movable with respect to the sliding member 56 in the apparatus width direction.

In addition, a thickness of the cam member 58 in the apparatus height direction (Z axial direction in FIG. 7B) becomes greater in the order of the first abutting section 60*a*, the second abutting section 60*b*, the third abutting section 60*c*, and the fourth abutting section 60*d*. In addition, the top surface 58*a* of the cam member 58 supports the abutting section 52*a* (refer to FIG. 8A and FIG. 8B) formed integral with the housing 52 of the carriage 36. In other words, the weight of the carriage 36 is applied to the cam member 58 through the abutting section 52*a*.

Figure 7A:
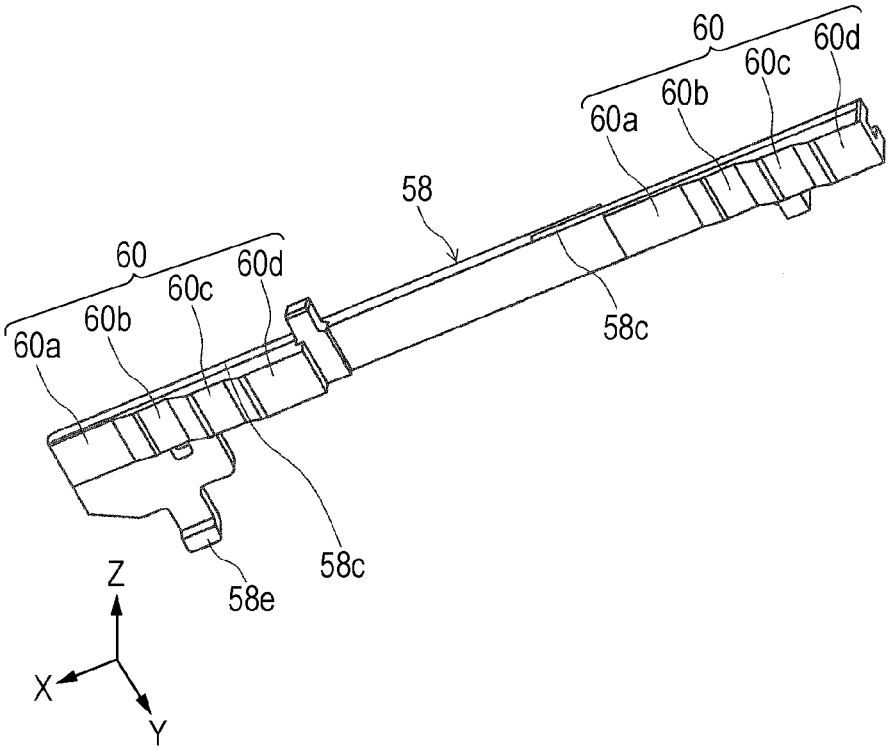
FIG. 7A is a perspective view illustrating a cam surface of the cam member and FIG. 7B is a side view illustrating the cam member when viewed from a side of the cam member on which the cam member comes into contact with a sliding section.
Figure 7B:
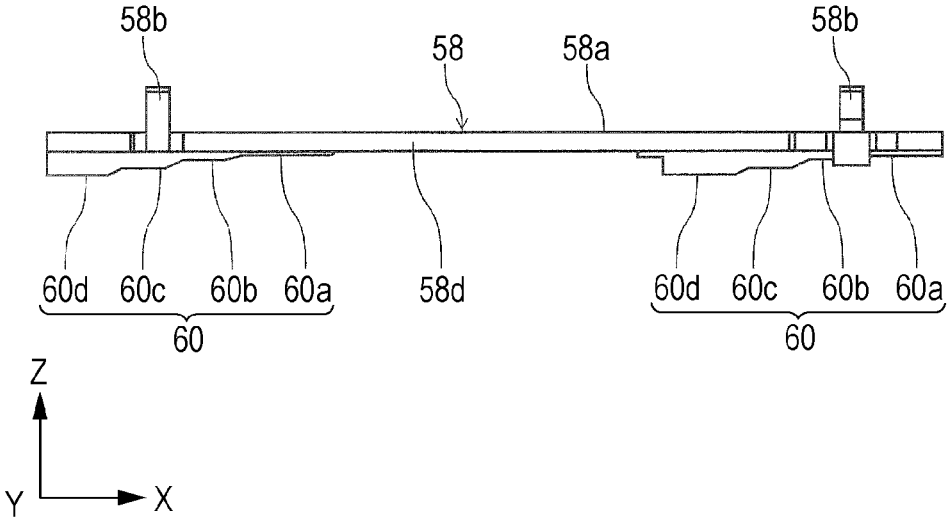

In addition, a pair of hook-shaped latching sections 58*b* are provided on the upper portion of the cam member 58 with an interval in the apparatus width direction (X axial direction in FIG. 7A and FIG. 7B). The abutting section 52*a* of the housing 52 is interposed between the top surface 58*a* of the cam member 58 and the hook-shaped latching section 58*b* in the apparatus height direction (Z axial direction in FIG. 9) in a state in which the cam member 58 is attached to housing 52 of the carriage 36 as illustrated in FIG. 9. According to the present example, a distance between the top surface 58*a* of the cam member 58 and the latching section 58*b* in the apparatus height direction is set to be slightly greater than the dimension of the abutting section 52*a* of the housing 52 in the apparatus height direction.

In addition, a first contact section 58*c* is formed on the end portion of the cam member 58 on the front side of the apparatus (−Y axial direction side in FIG. 7A) and comes into contact with the housing 52. In addition, a second contact section 58*d* is formed on the end portion of the cam member 58 on the rear side of the apparatus (+Y axial direction side in FIG. 7B) and comes into contact with the contact sections 56*d* and 56*d* of the sliding member 56. In addition, a protrusion 58*e* is provided on the end portion of the cam member 58 on the rear side of the apparatus and protrudes to the rear side of the apparatus.

Figure 8A:
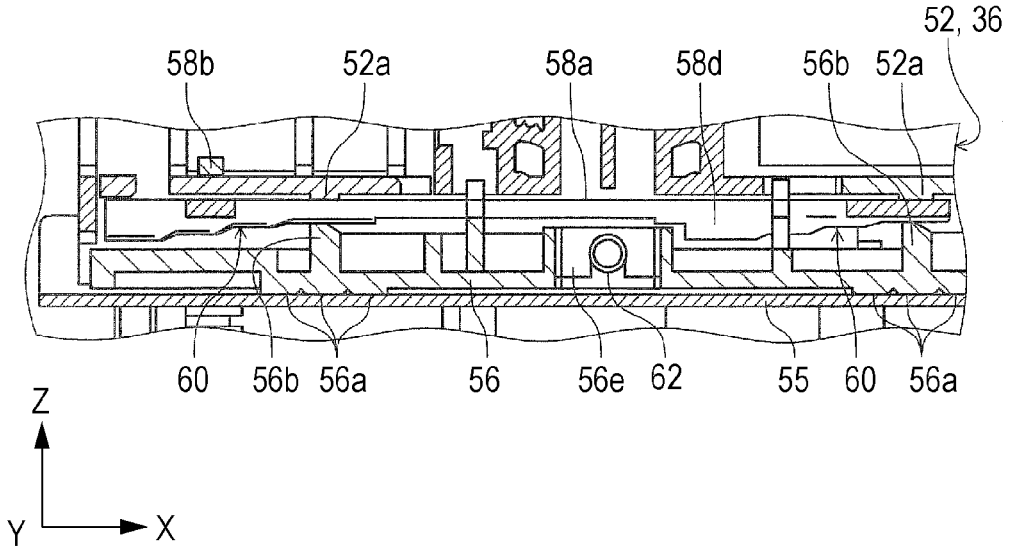
FIG. 8A is a partial sectional view illustrating a relationship between the cam member and the sliding member in a first gap position and FIG. 8B is a view illustrating a relationship between the cam surface of the cam member and the sliding member in the first gap position.
Figure 8B:
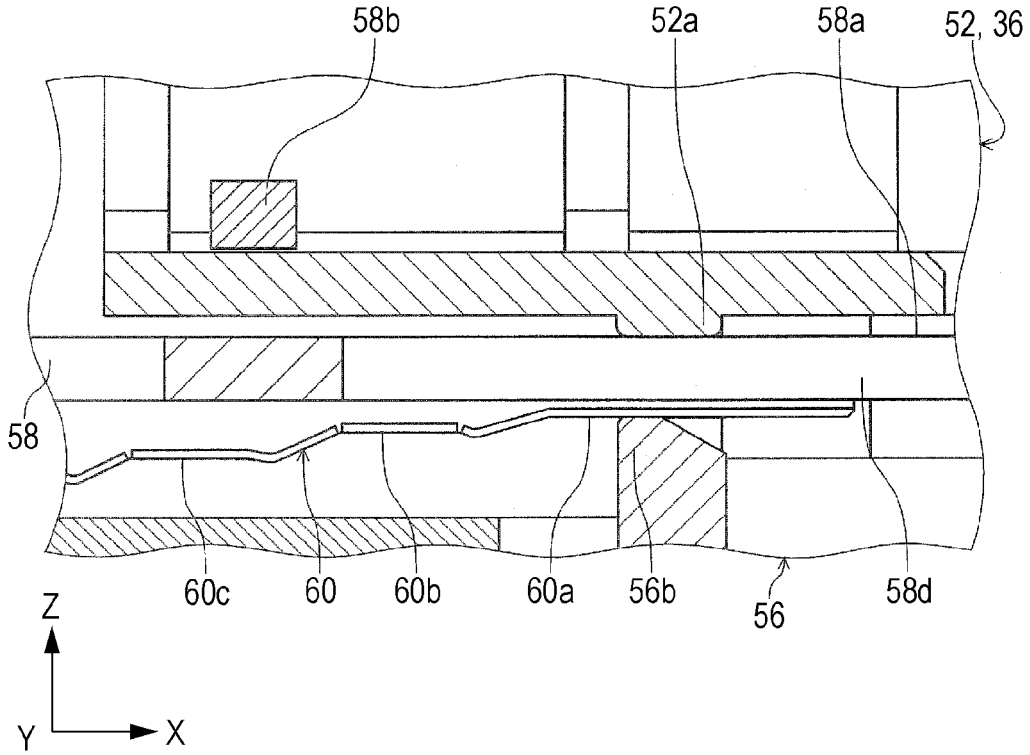

Here, with reference to FIG. 5, FIG. 8A, FIG. 8B, FIG. 9, FIG. 11A, and FIG. 11B, a configuration formed when the gap adjusting unit 54 is attached on the housing 52 of the carriage 36 will be described. The cam member 58 is attached in a state in which the abutting section 52*a* of the housing 52 is interposed between the top surface 58*a* of the cam member 58 and the latching section 58*b*. With reference to FIG. 8A, the sliding member 56 is disposed on the lower side of the cam member 58. In this state, the cam surface 60 of the cam member 58 comes into contact with the support 56*b* of the sliding member 56 (FIG. 8A and FIG. 8B illustrating a state in which the first abutting section 60*a* and the support 56*b* come into contact with each other) and the cam member 58 is supported by the sliding member 56.

Figure 11A:
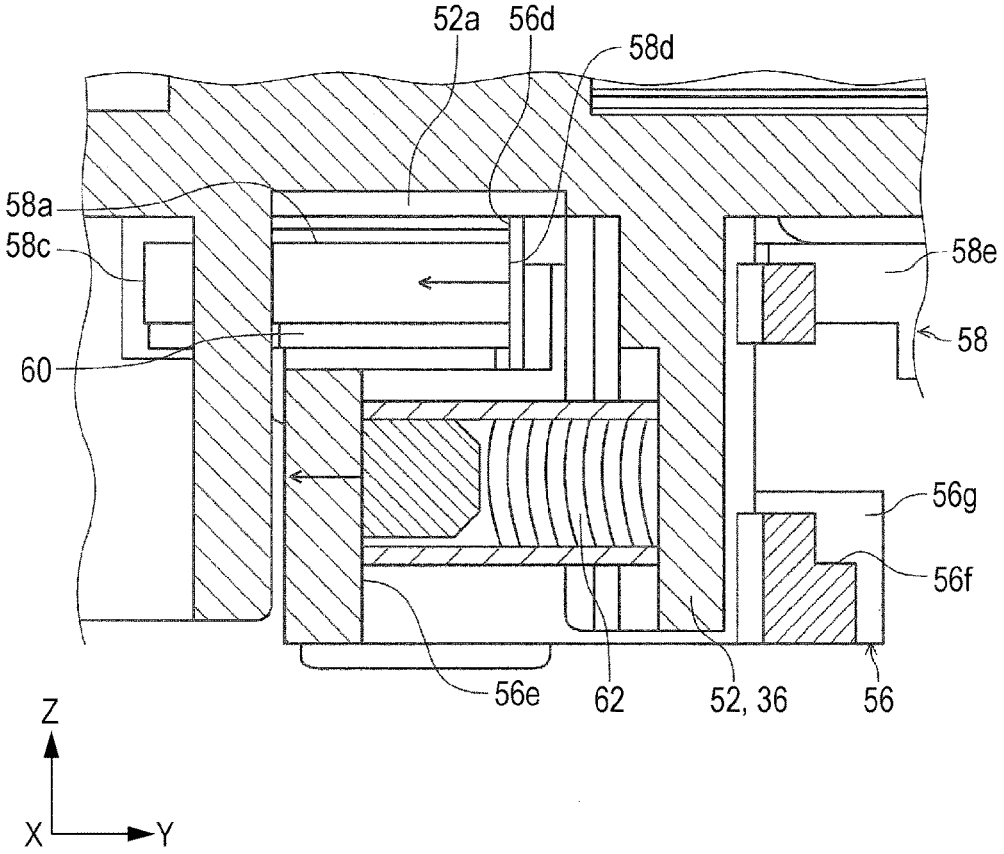
FIG. 11A is a sectional view illustrating a relationship between the carriage, the cam member, the sliding member, and a pressing member.
Figure 11B:
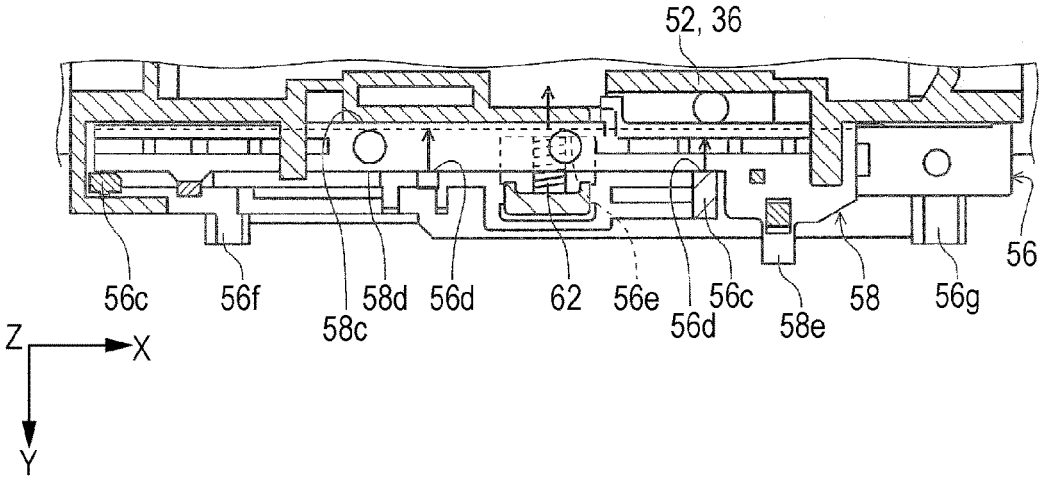
FIG. 11B is a partial sectional view illustrating a relationship between the carriage, the cam member, the sliding member, and the pressing member, when viewed from an upper side in an apparatus height direction.

In addition, with reference to FIG. 11A and FIG. 11B, a relationship between the housing 52, the sliding member 56, and the cam member 58 is described in the apparatus depth direction. Here, a part of the housing 52 is inserted into the pressing-member-accommodating section 56*e* of the sliding member 56. Then, the pressing member 62 is disposed in the pressing-member-accommodating section 56*e*. The pressing member 62 according to the present example is configured as a compression spring. One end of the pressing member 62 comes into contact with a part of the housing 52, which is inserted into the pressing-member-accommodating section 56*e*. The other end of the pressing member 62 presses the sliding member 56 to the front side in the apparatus depth direction (−Y axial direction in FIG. 11A)

Here, the contact section 56*d* of the sliding member 56 is in contact with the second contact section 58*d* of the cam member 58. Therefore, the pressing member 62 causes the sliding member 56 to be pressed to the front side in the apparatus depth direction and thereby, the contact section 56*d* of the sliding member 56 causes the cam member 58 to be pressed to the front side in the apparatus depth direction. As a result, the cam member 58 is pressed to the front side in the apparatus depth direction by the sliding member 56 such that the first contact section 58*c* of the cam member 58 is pushed to the housing 52 of the carriage 36. In other words, the pressing member 62 presses the cam member 58 using a press force thereof to the housing 52 of the carriage 36 through the sliding member 56.

According to the present example, as illustrated in FIG. 7A, the first contact section 58*c* of the cam member 58 is formed over the entire length of the cam member 58 in the apparatus width direction. In this manner, a contact area between the first contact section 58*c* of the cam member 58 and the housing 52 is increased and thereby, a static frictional force is increased. Here, the static frictional force between the cam member 58 and the housing 52 is set to be greater than an inertial force obtained by multiplying the weight of the cam member 58 and an acceleration of the carriage 36 during acceleration or deceleration.

Therefore, since the static frictional force between the cam member 58 and the housing 52 is greater than the inertial force, it is possible to hold the cam member 58 with respect to the housing 52 even when the press force of the pressing member 62 is small, and it is possible to cause the gap adjusting unit 54 to follow the movement of the carriage 36.

In addition, the present example has a configuration in which the press force of the pressing member 62 does not act in a change direction of the gap PG in the gap adjusting unit 54, that is, in the apparatus height direction, but acts in the apparatus depth direction. This means that the press force of the pressing member 62 does not act as a load which interferes with the change of the gap PG in the gap adjusting unit 54.

In addition, in the present example the contact sections 56*d* and 56*d* of the sliding member 56 come into contact with the second contact section 58*d* of the cam member 58 with an interval in the apparatus width direction. Here, during acceleration or deceleration of the carriage 36, angular moment which causes the carriage 36 to rotate in a clockwise or counterclockwise direction in FIG. 4 is generated in the carriage 36 due to a frictional force generated between the guide member 55 and the sliding section 56*a* of the sliding member 56. However, in the present example, the sliding member 56 and the cam member 58 are caused to be in contact with each other with an interval therebetween in the apparatus width direction such that it is possible to resist the angular moment. Therefore, it is possible to smoothly move the carriage 36 in the apparatus width direction.

Regarding Gap Switching in Gap Adjusting Unit

Subsequently, an adjustment of the gap PG in the gap adjusting unit 54 will be described. An engagement section is provided in the apparatus main body 12 and is shiftable between a position in the movement region of the carriage 36, at which engagement with the protrusion 58*e* of the cam member 58 is possible, and a position at which the engagement is not performed.

When the engagement section (not illustrated) is disposed at the position at which the engagement with the protrusion 58*e* of the cam member 58 is possible and the carriage 36 is caused to move, the protrusion 58*e* of the cam member 58 engages with the engagement section (not illustrated). In the state in which the protrusion 58*e* engages with the engagement section (not illustrated), when the carriage 36 is caused to move in the apparatus width direction, the cam member 58 moves relative to the housing 52 of the carriage 36 and the sliding member 56.

In a state in which the engagement section (not illustrated) constrains the protrusion 58*e* of the cam member 58 from moving in the apparatus width direction, the movement of the carriage 36 causes the cam member 58 to move relative to the housing 52 and the sliding member 56. Therefore, when the gaps PG are switched in the gap adjusting unit 54, actually, a shift in the X axial direction is performed by the housing 52 and the sliding member 56.

Figure 10A:
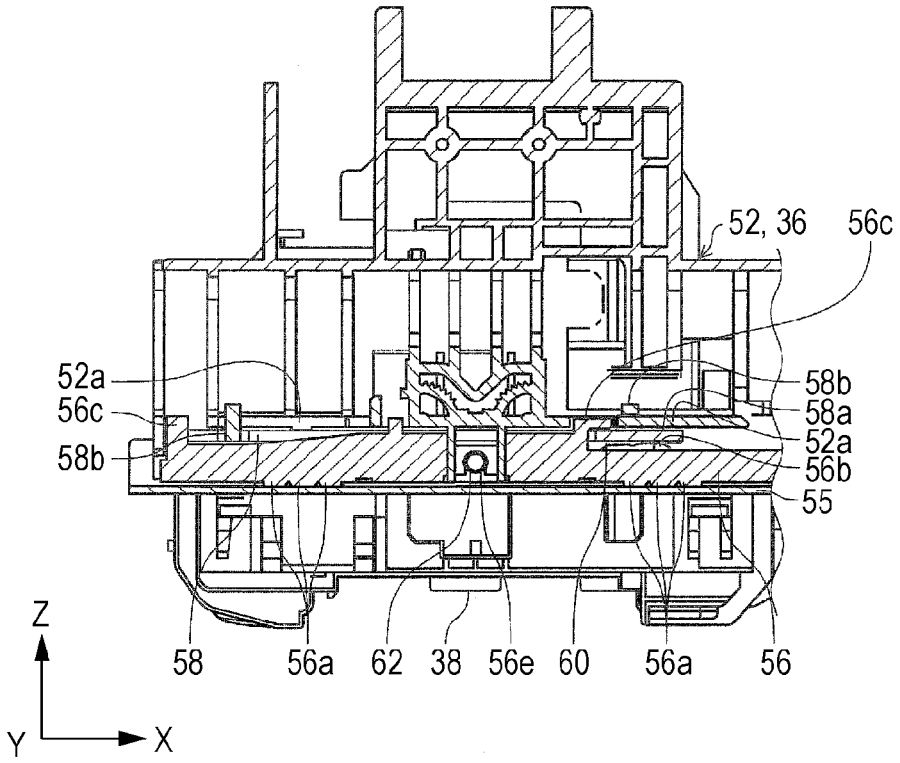
FIG. 10A is a partial sectional view illustrating the first gap position (regulation state) in the gap adjusting unit and FIG. 10B is a partial sectional view illustrating a second gap position (non-regulation state) in the gap adjusting unit.
Figure 10B:
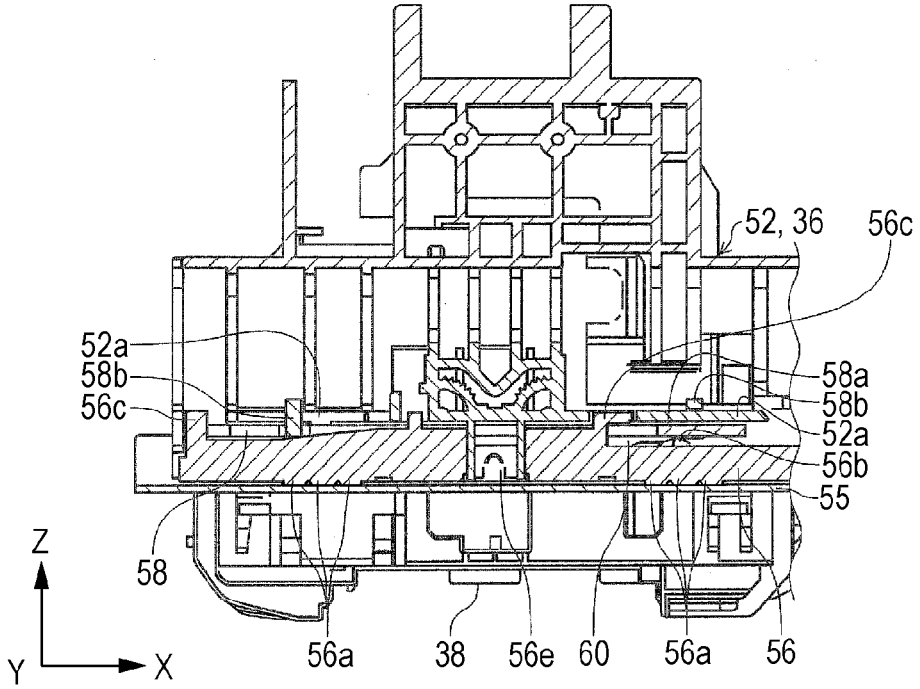

With reference to FIG. 10A and FIG. 10B, in the state in which the protrusion 58*e* of the cam member 58 engages with the engagement section (not illustrated), the movement of the carriage 36 causes the cam member 58 to move relative to the housing 52 and the sliding member 56 in the apparatus width direction. At this time, the cam surface 60 supported by the support 56*b* of the sliding member 56 also moves relative to the support 56*b*.

Here, in the state in which the engagement section (not illustrated) constrains the cam member 58 from moving in the apparatus width direction in FIG. 10A, the housing 52 and the sliding member 56 are caused to move relative to the cam member 58 in the +X axial direction in FIG. 10A. In this manner, switching of states is performed from a state, in which the support 56*b* is in contact with the first abutting section 60*a* of the cam surface 60, to contact states depending on a moving distance in the order of the second abutting section 60*b*, the third abutting section 60*c*, and the fourth abutting section 60*d*. FIG. 10B illustrates a state in which switching is performed from the state, in which the support 56*b* is in contact with the first abutting section 60*a* of the cam surface 60, to a state of being in contact with the second abutting section 60*b*.

As a result, since a thickness of abutting section increases in the order from the first abutting section 60*a* to the fourth abutting section 60*d*, the distance between the guide member 55 and the housing 52 of the carriage 36 in the apparatus height direction is increased. In other words, a distance between the recording surface of the paper sheet P supported by the platen 40 and the recording head 38, that is, the gap PG, is increased.

Meanwhile, in a state (not illustrated) in which the engagement section (not illustrated) constrains the cam member 58 from moving in the apparatus width direction and the support 56*b* of the sliding member 56 is in contact with the fourth abutting section 60*d*, the housing 52 and the sliding member 56 are caused to move relative to the cam member 58 in the −X axial direction in FIG. 10A. In this manner, switching is performed from the state in which the support 56*b* is in contact with the fourth abutting section 60*d* of the cam surface 60, to contact states depending on a moving distance in the order of the third abutting section 60*c*, the second abutting section 60*b*, and the first abutting section 60*a*.

As a result, since the thickness of the abutting section decreases in the order from the fourth abutting section 60*d* to the first abutting section 60*a*, the distance between the guide member 55 and the housing 52 of the carriage 36 in the apparatus height direction is decreased. In other words, the distance between the recording surface of the paper sheet P supported by the platen 40 and the recording head 38, that is, the gap PG, is increased.

As above, the cam member 58 is caused to move relative to the housing 52 and the sliding member 56 in the apparatus width direction (X axial direction) and thereby, it is possible to change the gap PG. A gap formed in the state in which the support 56*b* abuts on the first abutting section 60*a* is referred to as PG1, a gap formed in the state in which the support 56*b* abuts on the second abutting section 60*b* is referred to as PG2, a gap formed in the state in which the support 56*b* abuts on the third abutting section 60*c* is referred to as PG3, and a gap formed in the state in which the support 56*b* abuts on the fourth abutting section 60*d* is referred to as PG4.

In addition, which one of the first abutting section 60*a*, the second abutting section 60*b*, the third abutting section 60*c*, and the fourth abutting section 60*d* of the cam member 58, the support 56*b* of the sliding member 56 abuts on can be detected using an increase in a current value of a drive source (drive motor) (not illustrated) which drives the carriage 36, a movement direction of the carriage 36, and a moving distance of the carriage 36.

That is, it is possible to determine whether the gap PG is the minimum or maximum using the increase of the current value of the drive source (drive motor) (not illustrated) and it is possible to determine whether the gap PG changes to be increased or to be decreased in size using the movement direction of the carriage 36. The movement distance of the carriage 36 can be detected by a unit for detecting the movement distance of the carriage 36 with a linear encoder or the like (not illustrated).

In the present example, recording on regular paper is performed when the gap PG is PG1 and double-sided recording on regular paper or recording on cardboard, photographic paper, or the like, as an example of the medium, is performed when the gap PG is PG2. In addition, recording on an envelope is performed when the gap PG is PG4. In a case where the medium is subjected to rubbing when the gap PG is set to PG1 or PG2 and recording on the medium is performed, the gap PG is set to the PG3 greater than PG2 and thereby, it is possible to avoid causing the medium to be subjected to rubbing.

Regarding Gap Regulating Unit in Gap PG1

Figure 5:
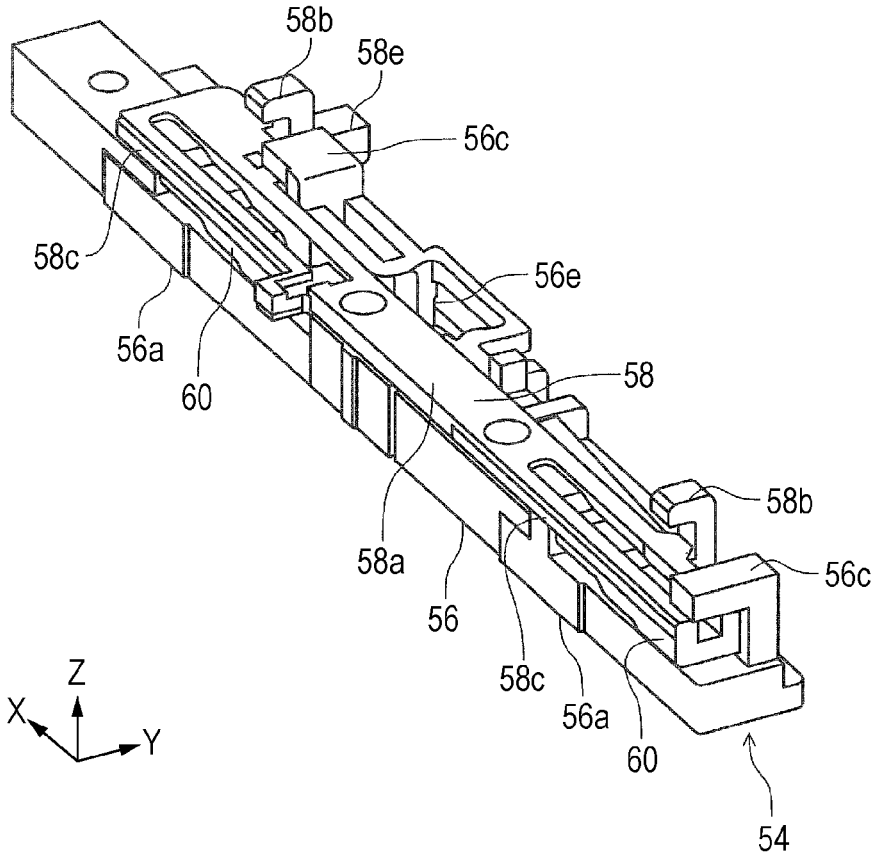
FIG. 5 is a perspective view illustrating a gap adjusting unit according to the first example.

A unit for regulating the gap change in the gap PG1 will be described for the second time, with reference to FIG. 5, FIG. 10A, and FIG. 10B. The regulation section 56*c* is provided in the sliding member 56. The regulation section 56*c* is formed to have a flange shape. In a state in which the cam member 58 has the gap PG1 with respect to the sliding member 56 in the apparatus width direction, that is, in the state in which the support 56*b* is in contact with the first abutting section 60*a*, the flange-shaped regulation section 56*c* engages with the top surface 58*a* of the cam member 58 (refer to FIG. 10A). In this state, the cam member 58 is in a regulation state in which the shift thereof in the apparatus height direction (Z axial direction in FIG. 10A) is regulated with respect to the sliding member 56. In other words, the gap PG1 is maintained.

Meanwhile, when the cam member 58 is caused to move relative to the sliding member 56 in the apparatus width direction from the regulation state, that is, the state of the gap PG1, the position of the flange-shaped regulation section 56*c* is changed with respect to the top surface 58*a* of the cam member 58 and the top surface 58*a* is released from the engagement state with the regulation section 56*c* (refer to FIG. 10B). As a result, the cam member 58 is released from the regulation by the regulation section 56*c* in the apparatus height direction. In other words, the cam member 58 can shift with respect to the sliding member 56 in the apparatus height direction and it is possible to change the gap PG. This state is referred to as a non-regulation state. In the present example, the state of the gap PG1 in the gap adjusting unit 54 means the regulation state and the states of the gaps PG2, PG3, and PG4 mean the non-regulation states.

Regarding Shift Regulating Unit of Carriage During Capping

Subsequently, a shift regulating unit of the carriage 36 in the apparatus height direction at the home position will be described with reference to FIG. 3, FIG. 6B, FIG. 9, and FIG. 12.

Flange-shaped regulation sections 55*a* and 55*b* (refer to FIG. 9) are provided at the end portion of the guide member 55, which is positioned at the home position, on the −X axial direction side in the apparatus width direction. In a state in which the carriage 36 is positioned at the home position, the regulation section 55*a* is positioned over the first regulated section 56*f*. In addition, the regulation section 55*b* is positioned over the second regulated section 56*g*.

In other words, when the carriage 36 is positioned at the home position and the recording head 38 is capped by the cap member 78, the cap member 78 is likely to lift the carriage 36 upward. Here, since the cam member 58 is constrained with respect to the housing 52 by the top surface 58*a* and the latching section 58*b*, the cam member 58 is likely to shift upward along with the housing 52 of the carriage 36. Further, when the sliding member 56 and the cam member 58 are in the regulation state with the gap PG1 described above, the cam member 58 is in the state in which the shift in the apparatus height direction is regulated with respect to the sliding member 56. Thus, the housing 52, the sliding member 56, and the cam member 58 integrally shift upward in the apparatus height direction.

At this time, since the sliding member 56 is lifted upward in the apparatus height direction, the regulation sections 55*a* and 55*b* engage with the first regulated section 56*f* and the second regulated section 56*g*, respectively. Then, the regulation sections 55*a* and 55*b* regulates an upward shift of the carriage 36 in the apparatus height direction through the sliding member 56 and the gap adjusting unit 54.

Next, when the sliding member 56 and the cam member 58 are in the non-regulation state, that is, with PG2, PG3, and PG4, the cam member 58 can shift with respect to the sliding member 56 in the apparatus height direction and thus, the housing 52 and the cam member 58 are likely to shift upward in the apparatus height direction. At this time, the sliding member 56 is in the state in which the upward shift in the apparatus height direction is regulated by the regulation sections 55*a* and 55*b*.

Figure 12:
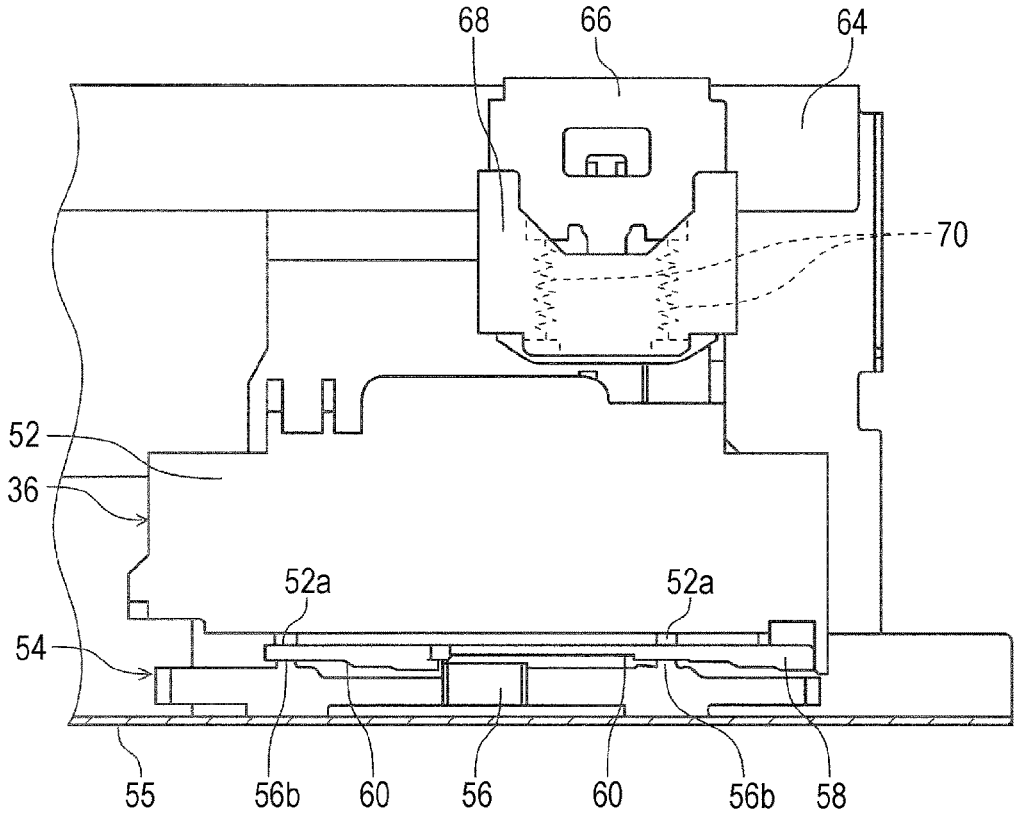
FIG. 12 is a view illustrating a regulation section that regulates the carriage not to shift beyond a predetermined position in a gap changing direction.

Here, with reference to FIG. 2 and FIG. 12, the engagement member 68 is provided on a mounting bracket 66 attached to a frame 64 provided in the apparatus main body 12. The engagement member 68 is positioned above the carriage 36 and is attached to the mounting bracket 66 to be slidable in the apparatus height direction. Bias members 70 and 70 are provided between the engagement member 68 and the mounting bracket 66. When the engagement member 68 shifts upward in the apparatus height direction, the bias member 70 biases the engagement member 68 downward in the apparatus height direction. The bias member 70 according to the present example is configured to be a spring.

In the present example, when the carriage 36 is capped by the cap member with any one of the gaps PG3 and PG4 and is lifted upward in the apparatus height direction, the engagement member 68 comes into contact with a part of the housing 52 of the carriage 36. Then, a bias force of the bias member 70 is transmitted to the carriage 36 through the engagement member 68. As a result, the bias force of the bias member 70 resists a force of the cap member 78 which lifts the carriage 36 and thus, it is possible for the carriage 36 to maintain the state of the gap PG3 or PG4.

Figure 16A:
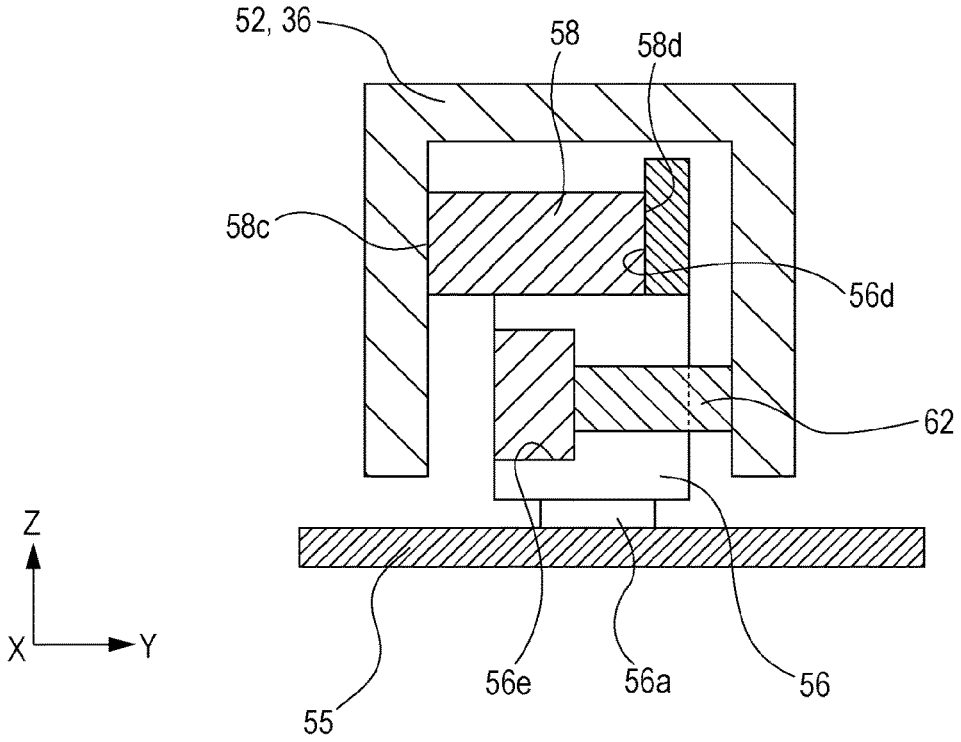
FIG. 16A is a sectional view illustrating the gap adjusting unit during non-capping according to the first example and FIG. 16B is a sectional view illustrating the gap adjusting unit during capping.
Figure 16B:
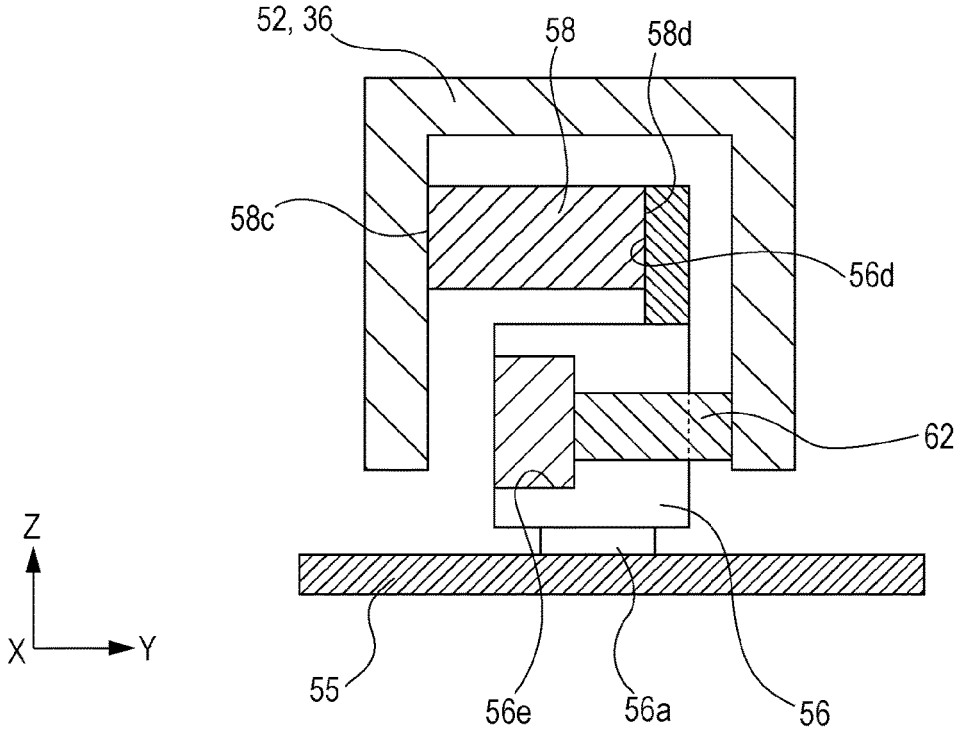
Figure 17:
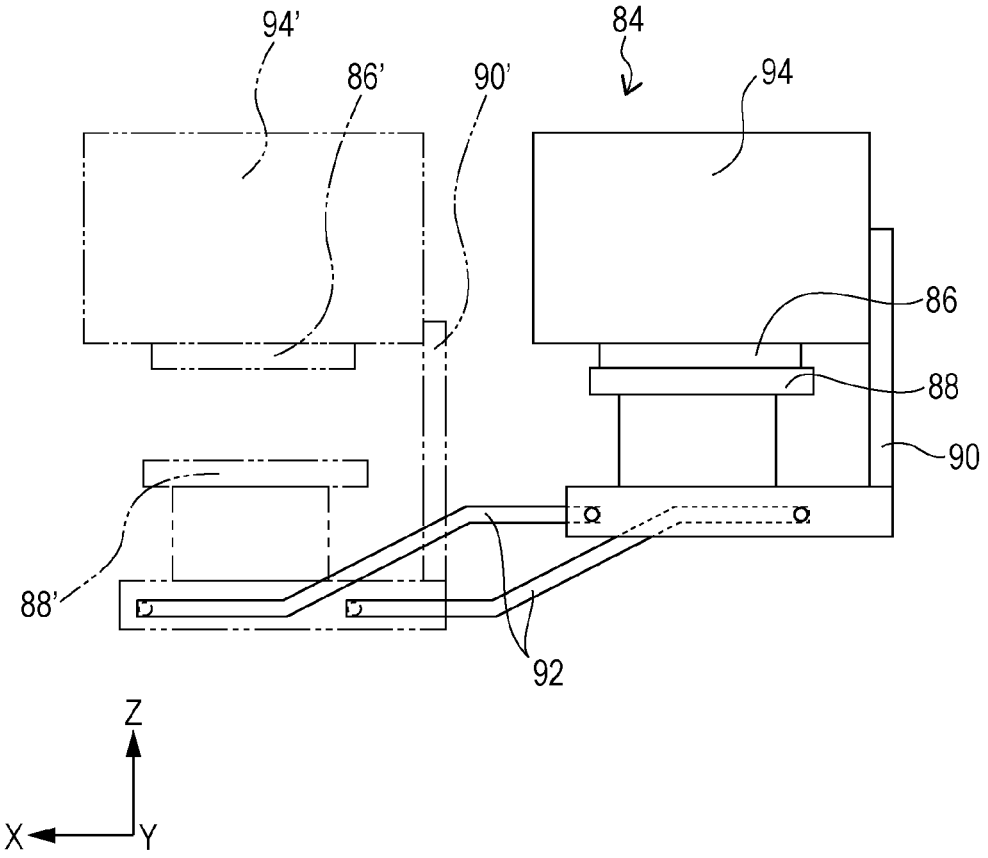
FIG. 17 is a view illustrating capping by a cap member in the related art.

In the present example, as illustrated in FIGS. 16A and 16B, in the state of gap PG2, when the recording head 38 is capped by the cap member 78, the cam member 58 engages with the housing 52 of the carriage 36 by the latching section 58*b* (refer to FIG. 9). Thus, the housing 52 of the carriage 36 and the cam member 58 are lifted upward in the apparatus height direction by the cap member 78 in the apparatus height direction and are in a state of being separated from the sliding member 56 (refer to FIG. 16B).

In other words, the cam member 58 shifts integral with the housing 52 of the carriage 36 in a direction in which the gap PG is changed. Thus, when the housing 52 shifts with respect to the sliding member 56 in the direction in which the gap PG is changed, it is possible to prevent the cam member 58 from being subjected to torsion due to a difference between a frictional force on a side of the cam member 58 on which the cam member comes into contact with the housing 52 and a frictional force on another side on which the cam member comes into contact with the sliding member 56.

In addition, in the present example, since the pressing member 62 presses the cam member 58 to the housing 52 of the carriage 36 through the sliding member 56 in the apparatus depth direction, a static frictional force is generated between the housing 52 and the cam member 58 and is greater than the inertial force obtained by multiplying the weight of the cam member 58 and the acceleration of the carriage 36 during acceleration or deceleration. As a result, even in a state in which the sliding member 56 and the cam member 58 are separated from each other in the apparatus height direction, it is possible to suppress the cam member 58 not to shift with respect to the housing 52 in the apparatus width direction.

In summary, the recording apparatus according to the present example includes the pressing member 62 that presses the cam member 58, which changes the gap PG between the housing 52 and the paper sheet P by moving in apparatus width direction corresponding to the first direction relative to the housing 52 of the carriage 36 and the sliding member 56, to the housing 52 of the carriage 36 in the apparatus depth direction intersecting with the apparatus width direction and the apparatus height direction corresponding to the direction in which the gap is changed. In this manner, when the recording head 38 is capped by the cap member 78, the housing 52 is lifted such that the cam member 58 and the sliding member 56 are separated from each other in the direction in which the gap PG is changed. Even in this case, since the cam member 58 is pressed to the housing 52 by the pressing member 62, it is possible to suppress the cam member 58 not to move relative to the housing 52 of the carriage 36 and the sliding member 56. In addition, since a force for suppressing the relative movement of the cam member 58 with respect to the housing 52 only needs to be equal to or greater than the inertial force obtained by multiplying the weight of the cam member 58 and the acceleration of the carriage 36 during acceleration or deceleration, it is possible to reduce the press force of the pressing member 62. As a result, it is possible to regulate the relative movement of the cam member 58 with respect to the housing 52 of the carriage 36 and the sliding member 56, with a low load.

In addition, the press force of pressing the cam member 58 to the housing 52 of the carriage 36 does not act in the direction in which the gap PG is changed. Therefore, the press force is not applied as an extra load during switching between the gaps PG by the gap adjusting unit 54 such that it is possible to reduce loads during the switching between the gaps PG.

In addition, in the present example, even though the housing 52 of the carriage 36 and the cam member 58 are separated from each other in the apparatus height direction, it is possible to press the cam member 58 to the housing 52 in the apparatus depth direction. As a result, since the static frictional force acts between the cam member 58 and the housing 52, it is possible to suppress the cam member 58 not to unexpectedly move in the apparatus width direction even in a state in which the housing 52 of the carriage 36 and the cam member 58 are separated from each other in the apparatus height direction. In addition, even though the force of pressing the cam member 58 to the carriage 36 is small, it is possible to follow the carriage 36 during acceleration and deceleration. Therefore, it is possible to simplify a holding structure of the cam member 58 to the carriage 36 and thus, it is possible to achieve miniaturization of the apparatus.

In addition, according to the present example, the pressing member 62 presses the cam member 58 through the sliding member 56. Here, when the pressing member 62 is the spring as an example and the cam member 58 moves along with the carriage 36 relative to the sliding member 56 in a configuration of directly pressing the cam member 58, the spring is also bent in response to the movement of the cam member 58 and thus, the direction of the force of pressing the cam member 58 is changed. As a result, it is not possible to stably press the cam member 58 to the carriage 36. In the present example, since the pressing member 62 presses the cam member 58 through the sliding member 56, the direction of the press force of the pressing member 62 is not changed even when the cam member 58 moves. As a result, the pressing member 62 can stably press the cam member 58 to the carriage 36.

In addition, according to the present example, the cam member 58 is pressed by the contact sections **56*d* of the sliding member 56 at at least the two positions with intervals in the apparatus width direction. Here, if the cam member 58 is pressed at one position in the apparatus width direction, there is a concern that torsion will be generated between the cam member 58 and the sliding member 56 due to angular moment generated in the carriage 36 during acceleration or deceleration of the carriage 36. In the present example, since the cam member 58 is pressed at at least the two positions with intervals in the apparatus width direction, it is possible to suppress the concern that torsion will be generated between the cam member 58 and the sliding member 56. As a result, it is possible to prevent an unstable movement of the carriage 36** in the apparatus width direction due to the generated torsion and thus to prevent recording quality from deteriorating.

In addition, according to the present example, since the pressing member 62 presses the sliding member 56 between the contact section **56*d* and the second contact section 58*d* which mean at least the two pressing positions in the apparatus width direction, it is possible for the press force of the pressing member 62 to be uniformly applied to the cam member 58 through the sliding member 56 between at least the two pressing positions, that is, the contact section 56*d* and the second contact section 58*d*, and it is possible to consistently press the cam member 58 to the housing 52 of the carriage 36**.

In addition, according to the present example, since the sliding member 56 has regulation sections **56*c* and 56*c* which come into contact with the cam member 58 and regulate the shift of the cam member 58 in the apparatus height direction, it is possible to reliably maintain the gap PG of the carriage 36 in the case where the sliding member 56 and the cam member 58 are in the regulation state. For example, when the position of the gap PG in the regulation state is set to the gap position PG1** of the regular paper on which recording is performed the most number of times, it is possible to easily maintain recording quality of the regular paper.

Modification Example of First Example (1) According to the present example, a configuration is employed, in which the pressing member 62 is provided at one position at the center portion of the sliding member 56 in the apparatus width direction; however, instead of the configuration, a configuration may be employed, in which a plurality of the pressing members are provided at intervals in the apparatus width direction.

(2) According to the present example, a configuration is employed, in which two contact sections **56*d* of the sliding member 56, which come into contact with the second contact section 58*d* of the cam member 58**, are provided with an interval in the apparatus width direction; however, a configuration may be employed, in which three or more contact sections are provided.

(3) According to the present example, a configuration is employed, in which the pressing member 62 is a compression spring; however, instead of the configuration, a configuration may be employed, in which the pressing member is a plate spring, an elastic body, or a material using a magnetic force.

(4) According to the present example, a configuration is employed, in which the capping operation of the cap member 78 is performed along with the movement in the direction in which the gap PG is changed and with the movement of the carriage 36 in the apparatus width direction; however, instead of the configuration, a configuration may be employed, in which the capping operation of the cap member 78 is performed only with the movement in the direction in which the gap PG is changed.

Second Example

The second example will be described with reference to FIG. 13. The present example is different from the first example in that the cam member 58 is not pressed to the housing 52 through the sliding member 56, but an elastic force of an elastic body provided between the housing 52 and the cam member 58 biases the cam member 58 to the sliding member 56.

Figure 13:
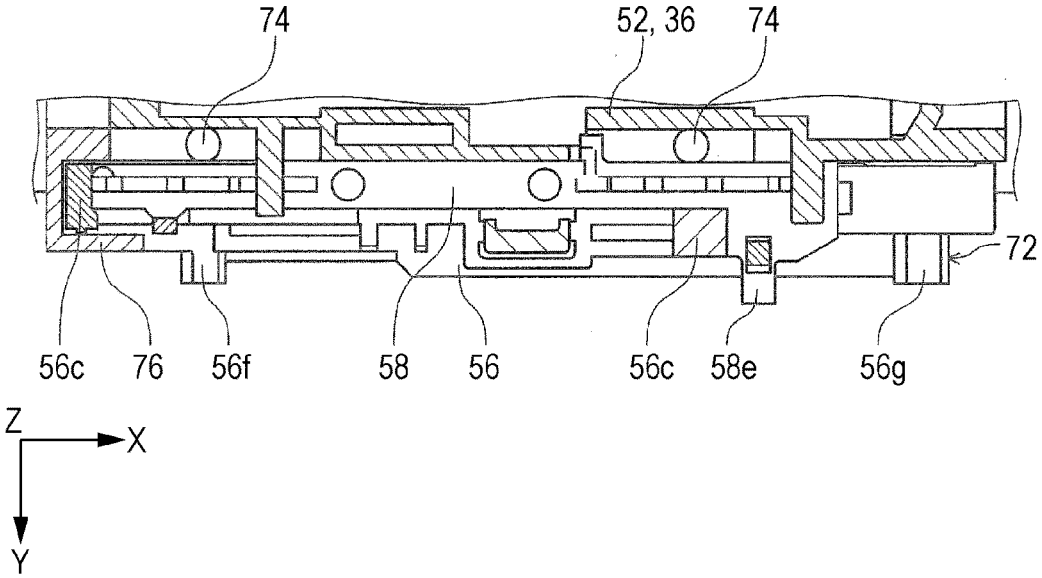
FIG. 13 is a partial sectional view illustrating a gap adjusting unit according to a second example, when viewed from an upper side in an apparatus height direction.

As illustrated in FIG. 13, an elastic member 74 is disposed between the housing 52 of the carriage 36 and the cam member 58 in the apparatus depth direction in the gap adjusting unit 72. According to the present example, the elastic member 74 is configured of a cylindrical member having the axial direction in the apparatus height direction, that is, a rubber roller.

In addition, according to the present example, a shift of the sliding member 56 to the rear side in the apparatus depth direction is regulated by a shift regulating unit 76 of the housing 52. In the present example, the elastic member 74 is disposed between the housing 52 and the cam member 58 in the apparatus depth direction. In addition, a distance between a contact section in the housing 52 with the elastic member 74 and the shift regulating unit 76 in the apparatus depth direction is set to be smaller than a sum of a size of the sliding member 56, a size of the cam member 58, and a size of the elastic member 74 in the apparatus depth direction. In other words, when the elastic member 74 is disposed between the housing 52 and the cam member 58, the elastic member 74 is crushed in the setting.

As a result, the elastic member 74 restores its original shape and biases the cam member 58 to the sliding member 56. Since the shift of the sliding member 56 to the rear side of the apparatus is regulated by the shift regulating unit 76, the cam member 58 receives a reactive force from the sliding member 56 side. In other words, friction is generated between the cam member 58 and the elastic member 74. This means that static frictional forces are generated between the housing 52 and the elastic member 74, and between the elastic member 74 and the cam member 58, respectively.

According to the present example, the elastic member 74 is provided between the carriage 36 and the cam member 58 and biases the cam member 58 to the sliding member 56. The cam member 58 receives the reactive force from the sliding member 56 and is biased to the carriage 36 through the elastic member 74. In this manner, when the recording head 38 is capped by the cap member 78, the housing 52 is lifted such that the cam member 58 and the sliding member 56 are separated from each other in the direction in which the gap PG is changed. Even in this case, since the cam member 58 is pressed to the housing 52, it is possible to suppress the cam member 58 not to move relative to the housing 52 of the carriage 36 and the sliding member 56. In addition, since the force for suppressing the relative movement of the cam member 58 with respect to the housing 52 only needs to be equal to or greater than the inertial force obtained by multiplying the weight of the cam member 58 and the acceleration of the carriage 36 during acceleration or deceleration, it is possible to reduce the bias force of the elastic member 74. As a result, it is possible to regulate the relative movement of the cam member 58 with respect to the housing 52 of the carriage 36 and the sliding member 56, with a low load.

In addition, the bias force from the elastic member 74 and the reactive force from the sliding member 56 do not act in the direction in which the gap PG is changed. Therefore, the bias force and the reactive force are not applied as extra loads during switching between the gaps PG by the gap adjusting unit 72 such that it is possible to reduce loads during the switching between the gaps PG.

In addition, according to the present example, since the elastic member 74 is the cylindrical member having the axis of the elastic member 74, which extends in the apparatus height direction, the cylindrical member rotates between the carriage 36 and the cam member 58 such that it is possible to reduce a sliding resistance of the cam member 58, when the cam member 58 moves in the apparatus width direction and the gaps PG are switched. In other words, it is possible to reduce the loads during the switching between the gaps PG in the gap adjusting unit 72.

In addition, according to the present example, the cam member 58 is biased by the elastic member 74 at at least two positions with intervals in the apparatus width direction. Here, if the cam member 58 is biased by the elastic member 74 at one position in the apparatus width direction, there is a concern that torsion will be generated between the cam member 58 and the sliding member 56, or between the cam member 58 and the elastic member 74, due to angular moment generated in the carriage 36 during acceleration or deceleration of the carriage 36. In the present example, since the cam member 58 is biased by the elastic member 74 at at least the two positions with intervals in the apparatus width direction, it is possible to suppress the concern that torsion will be generated between the cam member 58 and the sliding member 56, or between the cam member 58 and the elastic member 74. As a result, it is possible to prevent an unstable movement of the carriage 36 in the apparatus width direction due to the generated torsion and thus to prevent recording quality from deteriorating.

Modification Example of Second Example (1) In the present example, the elastic members 74 are provided at two positions with an interval in the apparatus width direction; however, the elastic members 74 may be provided at three or more positions in the apparatus width direction.

(2) According to the present example, the elastic member 74 is a rubber roller; however, the elastic member 74 may be a cylindrical member made of metal or a resin.

Third Example

The third example will be described with reference to FIG. 14. The present example is different from the first example in that the pressing member 62 does not press the cam member 58 through the sliding member 56, but directly presses the cam member 58.

Figure 14:
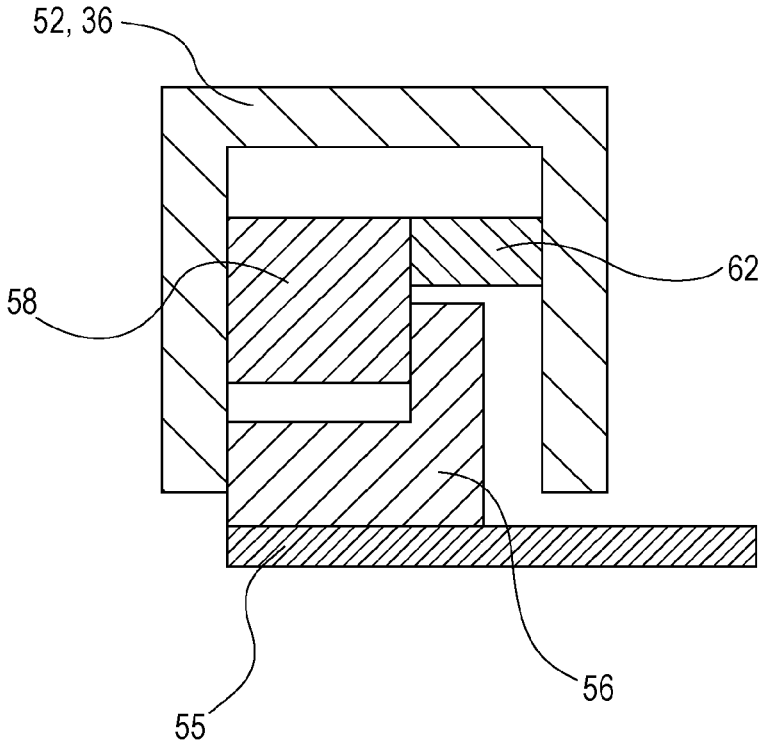
FIG. 14 is a view illustrating a relationship between the carriage, the cam member, the sliding member, and the pressing member, in a gap adjusting unit according to a third example.

In the present example, as illustrated in FIG. 14, one end of the pressing member 62 is attached to the housing 52 of the carriage 36 and the other end biases the cam member 58. In addition, at least two or more pressing members 62 (not illustrated) are provided with intervals in the apparatus width direction. In the present example, the pressing members 62 press the cam member 58 at two positions with an interval in the apparatus width direction. The sliding member 56 is configured to engage with the cam member 58 and to be slidable on the guide member 55.

According to the present example, the cam member 58 is pressed by the pressing members 62 at at least two positions with intervals in the apparatus width direction. Here, if the cam member 58 is pressed at one position in the apparatus width direction, there is a concern that torsion will be generated between the cam member 58 and the pressing member 62 due to angular moment generated in the carriage 36 during acceleration or deceleration of the carriage 36. In the present example, since the cam member 58 is pressed at at least two positions with intervals in the apparatus width direction, it is possible to suppress the concern that torsion will be generated between the cam member 58 and the pressing member 62. As a result, it is possible to prevent an unstable movement of the carriage 36 in the apparatus width direction due to the generated torsion and thus to prevent recording quality from deteriorating.

Modification Example of Third Example (1) According to the present example, the configuration is employed, in which the pressing members 62 are provided at two positions of the sliding member 56 with an interval in the apparatus width direction; however, instead of the configuration, a configuration may be employed, in which a plurality of the pressing members are provided with intervals in the apparatus width direction.

(2) According to the present example, the pressing member 62 may be configured to follow the shift of the cam member 58 in the apparatus height direction. Specifically, one end of the pressing member 62 attached to the housing 52 may be configured to shift in the apparatus height direction. According to this configuration, the pressing member 62 is able to follow the shift of the cam member 58 in the apparatus height direction. As a result, although the pressing member 58 shifts along with the housing 52 in the apparatus height direction, the pressing member 62 is able to stably press the cam member 58 to the housing 52 of the carriage 36 without changing the pressing direction of the pressing member 62 to the cam member 58.

Modification Example According to First to Third Examples

According to the present example, the housing 52 of the carriage 36 has a configuration in which a portion of accommodating an ink cartridge is integral with a portion of holding the recording head 38; however, instead of the configuration, a configuration may be employed, in which the carriage driving mechanism (not illustrated) is provided in the housing 52 and the portion of accommodating the ink cartridge and the portion of holding the recording head 38 are separately provided such that the portion of accommodating the ink cartridge is not linked to the portion of holding the recording head 38 when the recording head 38 is capped by the cap member 78. According to this configuration, when the recording head 38 is capped by the cap member 78, the portion of accommodating the ink cartridge in the housing 52 is not linked to a shift of the portion of holding the recording head 38 in the apparatus height direction. Hence, it is possible to maintain a consistent load of a belt in the carriage driving mechanism (not illustrated) without changing the position of the carriage driving mechanism (not illustrated) in the apparatus height direction.

In addition, in the present example, the gap adjusting unit 54 or 72 is applied to an ink jet printer as an example of the recording apparatus and can be applied to other liquid ejecting apparatuses, in general.

Here, examples of the liquid ejecting apparatus include not only a recording apparatus such as a printer, a multifunction printer, or a facsimile, in which an ink jet type recording head is used, ink is discharged from the recording head, and recording is performed on a recording medium, but also an apparatus in which, instead of the ink, a liquid corresponding to the usage of the ink is ejected onto an ejection target medium corresponding to the recording medium, from a liquid ejecting head corresponding to the ink jet type recording head, and the liquid is caused to adhere to the ejection target medium.

Examples of the liquid ejecting head include, in addition to the recording head, a color material ejecting head which is used in manufacturing of a color filter such as a liquid crystal display, an electrode material (conductive paste) ejecting head which is used in electrode formation such as an organic EL display or a field emission display (FED), a bioorganic material ejecting head which is used in manufacturing of biochips, a sample ejecting head as an accurate pipette, or the like.

It is needless to say that the invention is not limited to the examples described above, but can be modified in various ways within the scope of the invention described in the aspects, and the modified ones are included in the scope of the invention.

The entire disclosure of Japanese Patent Application No. 2014-204897, filed Oct. 3, 2014 is expressly incorporated by reference herein.

What is claimed is:

1. A recording apparatus comprising:

a carriage that has a housing in which a recording head is provided and performs recording on a medium and that is movable in a first direction;

a guide member that extends in the first direction, supports the carriage, and guides the carriage in the first direction;

a gap adjusting unit that adjusts a position of the housing with respect to the guide member and thereby adjusts a gap between the medium and the recording head; and a cap member which is movable in a direction in which the gap is changed, and by which the recording head is capped, wherein the gap adjusting unit includes a sliding member that slides over an upper side of the guide member in response to a movement of the carriage, a cam member that is interposed between a part of the housing and the sliding member and has a shape with which the housing of the carriage is caused to shift in the direction in which the gap is changed, by moving in the first direction relative to the housing and the sliding member, and a pressing member that presses the cam member to the housing of the carriage in a second direction intersecting with the first direction and the direction in which the gap is changed.

2. The recording apparatus according to claim 1, wherein the cam member engages with the housing of the carriage.

3. The recording apparatus according to claim 1, wherein the pressing member presses the cam member to the housing of the carriage through the sliding member.

4. The recording apparatus according to claim 3, wherein the cam member is pressed by the sliding member at at least two positions with intervals in the first direction.

5. The recording apparatus according to claim 4, wherein the pressing member presses the sliding member between at least the two pressing positions in the first direction.

6. The recording apparatus according to claim 1, wherein the cam member is pressed by the pressing members at at least two positions with intervals in the first direction.

7. The recording apparatus according to claim 1, wherein the pressing member is able to move along with the shift of the carriage in the direction in which the gap is changed.

8. The recording apparatus according to claim 1, wherein the sliding member has a regulation section that comes into contact with the cam member and regulates a shift of the cam member in the direction in which the gap is changed, and wherein the gap adjusting unit is able to perform switching between a regulation state in which the regulation section regulates a shift of the cam member in the direction in which the gap is changed and a non-regulation state in which the cam member is caused to move relative to the sliding member and thereby the regulation state is cancelled.

* * * * *